US006276991B1

(12) United States Patent
Kobayashi et al.

(10) Patent No.: US 6,276,991 B1
(45) **Date of Patent: *Aug. 21, 2001**

(54) CROWN FORMING METHOD OF FORMING CROWN ON FLOATING TYPE MAGNETIC HEAD

(75) Inventors: Hideaki Kobayashi; Koichi Nakagawa; Isao Nakabayashi; Katsuya Sugai, all of Niigata-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/439,137

(22) Filed: Nov. 12, 1999

(30) Foreign Application Priority Data

Nov. 17, 1998 (JP) ..... 10-327339
Nov. 17, 1998 (JP) ..... 10-327340
Nov. 17, 1998 (JP) ..... 10-327341

(51) Int. Cl.[7] ..... B24B 1/00
(52) U.S. Cl. ..... 451/28; 451/259
(58) Field of Search ..... 451/28, 259

(56) References Cited

U.S. PATENT DOCUMENTS 5,365,700 * 11/1994 Sawada et al. ..... 451/28
5,603,156 * 2/1997 Biskeborn et al. ..... 451/259
5,713,123 2/1998 Toyoda et al. .
5,951,371 * 9/1999 Hao ..... 451/259
6,123,608 * 9/2000 Nakagawa et al. ..... 451/259

FOREIGN PATENT DOCUMENTS 5-298646 11/1993 (JP) .
6-223524 8/1994 (JP) .

* cited by examiner

*Primary Examiner*—Derris H. Banks
*Assistant Examiner*—Hadi Shakeri
(74) *Attorney, Agent, or Firm*—Brinks Hofer Gilson & Lione

(57) ABSTRACT

A crown forming method of forming a crown on a floating type magnetic head which includes the steps of placing an approximately rectangular-prism-shaped bar, which has magnetic head elements of not less than 1 formed on a side wall thereof in a row, on the convex surface of a jig whose radius of curvature is $R_1$ through an elastic sheet while facing the surface to be processed of the bar to a lapping surface plate having a concave processing surface whose radius of curvature is $R_2$ with the relationship between the radius of curvatures set to $R_1 \geqq R_2$, deforming the bar to an arc shape along the longitudinal direction thereof and bonding it on the convex surface together with the elastic sheet, and lapping the surface to be processed by abutting it against the processing surface and moving the surface to be processed relative to the processing surface. A plurality of grooves may be formed on the surface to be processed between the respective magnetic head elements along the short direction of the bar so that the bar is divided into a plurality of divided surfaces, and lapping the respective divided surfaces of the bar is performed by abutting them against the concave processing surface of the lapping surface plate and moving the bar relative to the processing surface.

12 Claims, 22 Drawing Sheets

82a
82
81
82a 84a
81
83
84

84
85

87
86

85a
85

127
128

127
128
129
130
131
132
132

127
128
128
129
132

136
136
136
128
129
132

133
134
129
127
135
128
136
136

136
128
137

CROWN FORMING METHOD OF FORMING CROWN ON FLOATING TYPE MAGNETIC HEAD

BACKGROUND OF THE INVENTION

1. Field of the Invention

The present invention relates to a crown forming method of forming a crown on the floating surface of a floating type magnetic head.

2. Description of the Related Art

Floating type magnetic heads record and reproduce information to and from magnetic recording mediums while floating therefrom.

The floating type magnetic head is operated by a so-called CSS system in such a manner that it is floated from the magnetic recording medium by the movement thereof and placed on the magnetic recording medium again when it stops.

Since the surfaces of the floating type magnetic head and the magnetic recording medium, which confront each other, have high flatness, they are liable to be adsorbed by each other. Thus, it is possible that a drawback is caused to the floating type magnetic head and the magnetic recording medium.

To cope with this problem, the absorption between the floating type magnetic head and the magnetic recording medium is prevented by forming the floating surface of the floating type magnetic head to a convex surface so as to reduce the area where the floating surface is in contact with the magnetic recording medium.

The convex surface formed on the floating surface is referred to as a crown. Various methods are conventionally employed to form the crown.

Conventional methods of forming a crown on a floating type magnetic head will be described with reference to drawings.

FIGS. 15A–15E show a first example of the conventional methods of forming a crown on a floating type magnetic head.

In FIGS. 15A–15E, an approximately rectangular-prism-shaped bar 61 having floating type magnetic head elements disposed thereto in a row and a groove jig 62 are prepared.

The bar 61 has the plurality of magnetic head elements formed on a surface (left side surface) 61*a* thereof. The bar 61 is made in such a manner that a wafer having a multiplicity of magnetic head elements formed thereto is cut to have an approximately rectangular-prism-shape and other surface (bottom surface) 61*c* is polished and the gaps between the magnetic head elements and coils are adjusted. Further, the groove jig 62 has a groove 62*a* formed on a surface (upper surface) thereof.

Next, a melted wax 63 is coated to the groove 62*a* and the bar 61 is placed on the groove jig 62 with the other surface 61*c* facing downward so that the other surface 61*c* comes into contact with the wax 63.

Then, the wax 63 is cooled and solidified so that it is contracted, whereby the bar 61 is deformed to an arc-shape. The bar 61 is fixed to the groove jig 62 by the wax 63. At the time, the other surface 61*c* of the curved bar is made to a convex surface.

Subsequently, the surface 61*b* of the bar 61, which is curved in confrontation with the other surface 61*c* is polished and flatly cut, thereby obtaining the floating type magnetic head.

A floating type magnetic head is obtained by removing the bar 61 from the groove jig 62 and cutting it in the longitudinal direction thereof at equal intervals.

The floating type magnetic head has a crown which is made to the convex surface by the deformation of the bar 61.

FIGS. 16A–16C show a second example of the conventional methods of forming a crown on a floating type magnetic head.

In FIGS. 16A–16C, first, an approximately rectangular-prism-shaped magnetic head slider 71 is prepared. The magnetic head slider 71 has magnetic head elements (not shown) previously disposed thereon. Further, the magnetic head slider 71 has a pair of rails 72*a* and 72*a* formed on the floating surface 72 thereof.

Next, a laser beam 74 is irradiated between the rails 72*a* and 72*a* of the magnetic head slider 71 so as to form a plurality of cracks 73 . . . along the short direction of the magnetic head slider 71.

Subsequently, the magnetic head slider 71 is deformed to an arc shape along the longitudinal direction thereof, thereby making the floating surface 72 of the magnetic head slider 71 to a convex surface. Since the cracks 73 . . . are formed on the floating surface 72, the magnetic head slider 71 can be easily deformed. With this process, a crown is formed on the floating surface 72 of the magnetic head slider 71.

FIGS. 17A–17E show a third example of the conventional methods of forming a crown on a floating type magnetic head.

In FIGS. 17A–17E, first, an approximately rectangular-prism-shaped magnetic head slider 81 is prepared. Further, a lapping surface plate 85 having a concave processing surface 85*a* is prepared.

Magnetic head elements (not shown) are previously formed on the magnetic head slider 81. Further, a pair of rails 82*a* and 82*a* are formed on the floating surface 82 of the magnetic head slider 81.

Next, the magnetic head slider 81 is fixed on the flat surface 84*a* of a jig 84 through an elastic sheet 83 with the floating surface 82 facing upward.

Then, the jig 84, on which the magnetic head slider 81 is fixed, is placed on the fixing plate 85 in such a manner that the floating surface 82 of the magnetic head slider 81 is abutted against the processing surface 85*a* of the fixing plate 85.

Subsequently, a polishing agent is sprayed on the processing surface 85*a* and the processing surface 85*a* is pressed against the floating surface 82 by imposing a load on the magnetic head slider 81 by the jig 84. Further, the jig 84 is rotated while rotating the lap fixing plate 85 so that lapping is carried out by causing the floating surface 82 of the magnetic head slider 81 and the processing surface 85*a* to slide each other.

At the time, since the shape of the processing surface 85*a* is transferred onto the floating surface 82, the floating surface 82 is formed to a convex surface having a radius of curvature similar to that of the processing surface 85*a*.

The thus obtained magnetic head slider 81 has a crown 87 formed thereon which has a convex surface along the longitudinal direction and the short direction of the magnetic head slider 81.

FIGS. 19A–19F show a fourth example of the conventional methods of forming a crown on a floating type magnetic head.

In FIGS. 19A–19F, first, an approximately rectangular-prism-shaped bar 127 is prepared. The bar 127 is made in such a manner that after a multiplicity of head elements are formed on a surface of a wafer composed of a material of the slider of a floating type magnetic head using a thin film forming technology or the like, a portion of the wafer is cut to a rectangular-prism-shape. A plurality of magnetic head elements 128 . . . are disposed on a side wall of the bar 127 in a row.

Next, a spring type concave/convex jig 129 is mounted on the bar 127.

The spring type concave/convex jig 129 is composed of a spring sheet 130 and a concave/convex sheet 131 jointed to both the ends of the spring sheet, and grooves 132 are formed to the concave/convex sheet 131 at predetermined intervals. The spring type concave/convex jig 129 can be elastically deformed along the longitudinal direction thereof.

The bar 127 is mounted on the spring type concave/convex jig 129 such that the grooves 132 of the spring type concave/convex jig 129 are located between the respective magnetic head elements 128.

Next, the bar 127 is cut at equal intervals along the short direction thereof and made to chips 138 . . . The 127 is cut at the positions of the grooves 132 of the spring type concave/convex jig 129.

Next, the spring type concave/convex jig 129 is mounted on a columnar jig 133. An elastic member 134 is interposed between the spring type concave/convex jig 129 and the columnar jig 133.

Further, one surfaces 136 . . . of the respective chips 138 . . . are pressed against a concave processing surface 135 and the one surfaces 136 . . . are subjected to lapping by moving the columnar jig 133 relative to the processing surface 135.

Since the processing surface 135 is formed to the concave surface, the spring type concave/convex jig 129 and the elastic member 134 are elastically deformed so that the one surfaces 136 . . . of all the chips 138 . . . come into contact with the processing surface 135.

The shape of the processing surface 135 is transferred onto the one surfaces 136 . . . of the chips 138 . . . by the lapping.

Finally, a floating type magnetic head 137 is obtained by removing the respective chips 138 . . . from the spring type concave/convex jig 129. With this processing, a convex crown is formed on the one surface 136 (floating surface) of the floating type magnetic head 137 in the longitudinal direction thereof and at the same time a convex cross crown is formed in the short direction thereof.

However, the first example of the conventional methods of forming a crown on a floating type magnetic head has a problem in that the shapes of crowns are liable to be varied because the formation of the crowns depends on the contraction of the wax 63 and the groove 62*a* of the groove jig 62.

The second example of the conventional methods of forming a crown on a floating type magnetic head has a problem in that a process is complicated and productivity is low because the cracks 73 must be formed by irradiating the laser beam 74 a plurality of times.

In addition to the above problem, the second example has a problem that the respective curvatures of the crown and the cross crown cannot be independently adjusted.

The third example of the conventional methods of forming a crown on a floating type magnetic head has a problem in that productively is low because the magnetic head sliders 81 are handled one by one. In addition, the third example has another problem in that the shape of the crown is made to the convex surface which is convex in the longitudinal direction and the short direction of the magnetic head slider 81 and thus a crown which is convex only in the longitudinal direction of the magnetic head slider 81 cannot be formed.

In contrast, the fourth example of the conventional methods of forming a crown on a floating type magnetic head has a problem in that the shape of the processing surface 135 must be changed to change the shapes of the crown and the cross crown because the processing surface 135 is transferred onto the crown and the cross crown.

An object of the present invention, which was made to solve the above problems, is to provide a crown forming method having high productivity and capable of forming a crown which is convex only in the longitudinal direction of a slider with a less amount of variation of the shape of the crown.

An object of the present invention is to provide a crown forming apparatus having high productivity and capable of forming a crown which is convex only in the longitudinal direction of a slider with a less amount of variation of the shape of the crown.

An object of the present invention is to provide a method of forming a crown on a floating type magnetic head having high productivity and capable of simultaneously forming a crown and a cross crown with a less amount of variation of the shapes of the crown and the cross crown and easily changing the shapes of the crown and the cross crown.

An object of the present invention is to provide a crown forming apparatus having high productivity and capable of simultaneously forming a crown and a cross crown with a less amount of variation of the shapes of the crown and the cross crown and easily changing the shapes of the crown and the cross crown.

SUMMARY OF THE INVENTION

To achieve the above objects, the present invention has employed the following arrangements.

In a crown forming method of the present invention for forming a crown on a floating type magnetic head by lapping the surface to be processed of an approximately rectangular-prism-shaped bar which is adjacent to a side wall thereof having magnetic head elements of not less than 1 disposed thereon in a row and cutting the bar in the short direction thereof to manufacture the floating type magnetic head having a floating surface composed of the surface to be processed and at least one piece of the magnetic head elements, the method is characterized by including the steps of placing the bar on the convex surface of a jig whose radius of curvature is $R_1$ through an elastic sheet while facing the surface to be processed of the bar to a lapping surface plate having a concave processing surface whose radius of curvature is $R_2$ with the relationship between the radius of curvatures set to $R_1 \geqq R_2$; deforming the bar to an arc shape along the longitudinal direction thereof and bonding it on the convex surface together with the elastic sheet; and lapping the surface to be processed of the bar by abutting it against the processing surface of the lapping surface plate and moving the surface to be processed relative to the processing surface, thereby forming the crown on the floating surface of the floating type magnetic head.

In the above crown forming method of forming a crown on a floating type magnetic head, the surface to be processed of the bar is preferably moved relative to the processing surface of the lapping surface plate by rotating the lapping surface plate and swinging the bar in a direction perpendicular to the rotating direction of the lapping surface plate.

In the above crown forming method of forming a crown on a floating type magnetic head, a dummy bar, which has the same shape as that of the bar and is composed of the same material as that of the bar, is preferably bonded to the convex surface of the jig through an elastic sheet spaced apart from the bar in parallel with the longitudinal direction thereof.

A crown forming apparatus of the present invention is characterized by including a lapping surface plate having a concave processing surface; a jig having a convex surface; and a drive means for moving the jig relative to the processing surface while causing the convex surface of the jig to be confronted with the processing surface of the lapping surface plate, wherein the radius of curvature $R_1$ of the convex surface of the jig and the radius of curvature $R_2$ of the processing surface of the lapping surface plate are set to $R_1 \geqq R_2$; and an approximately rectangular-prism-shaped bar, which has magnetic head elements of not less than 1 disposed on a side wall thereof in a row, is bonded to the convex surface of the jig through an elastic sheet while being deformed to an arc shape along the longitudinal direction thereof with the surface to be processed thereof facing to the lapping surface plate, and the surface to be processed of the bar is abutted against the processing surface.

The drive means preferably includes a rotation mechanism for rotating the lapping surface plate and a swing mechanism for pressing the surface to be processed of the bar against the processing surface of the lapping surface plate while holding the jig and swinging the jig in a direction perpendicular to the rotating direction of the lapping surface plate and the bar is preferably mounted on the jig so that the longitudinal direction of the bar is in agreement with the swing direction of the jig.

In the above crown forming apparatus, a dummy bar, which has the same shape as that of the bar and is composed of the same material as that of the bar, is preferably bonded to the convex surface of the jig through an elastic sheet spaced apart from the bar in parallel with the longitudinal direction thereof.

In a crown forming method of the present invention for forming a crown on a floating type magnetic head by lapping the surface to be processed of an approximately rectangular-prism-shaped bar which is adjacent to a side wall thereof having magnetic head elements of not less than 1 disposed thereon in a row or in a plurality of rows and cutting the bar in the short direction thereof to manufacture the floating type magnetic head having a floating surface composed of the surface to be processed and at least one piece of the magnetic head elements, the method is characterized by including the steps of making the surface to be processed to a plurality of divided surfaces by disposing at least one groove on the surface to be processed of the bar so as to be located between the respective magnetic head elements along the short direction of the bar; deforming the bar to an arc shape along the longitudinal direction thereof and bonding it on the convex surface of a jig while facing the respective divided surfaces of the bar to a lapping surface plate having a concave processing surface; and lapping the respective divided surfaces of the bar by abutting them against the processing surface of the lapping surface plate and moving the respective divided surfaces relative to the processing surface, thereby forming the crown on the floating surface of the floating type magnetic head.

The number of the grooves formed between the respective magnetic head elements is preferably 1.

In the crown forming method for forming a crown on a floating type magnetic head, the respective divided surfaces of the bar are preferably moved relative to the processing surface of the lapping surface plate by rotating the lapping surface plate and swinging the bar in a direction perpendicular to the rotating direction of the lapping surface plate.

Further, in the above crown forming method for forming a crown on a floating type magnetic head, lapping is preferably executed by boding a dummy bar, which has the same shape as that of the bar and is composed of the same material as that of the bar, to the convex surface of the jig spaced apart from the bar in parallel with the longitudinal direction thereof.

A crown forming apparatus is characterized by including a lapping surface plate having a concave processing surface; a jig having a convex surface; and a drive means for moving the jig relative to the processing surface while causing the convex surface of the jig to be confronted with the processing surface of the lapping surface plate, wherein an approximately rectangular-prism-shaped bar, which has magnetic head elements of not less than 1 disposed on a side wall thereof and at least one groove disposed on the surface to be processed thereof so as to locate between the respective magnetic head elements along the short direction of the surface to be processed so that the surface to be processed is made to a plurality of divided surfaces, is bonded to the convex surface of the jig while being deformed to an arc shape along the longitudinal direction thereof with the respective divided surfaces facing to the lapping surface plate, and the respective divided surfaces of the bar are abutted against the processing surface of the lapping surface plate.

The number of the grooves formed between the respective magnetic head elements is preferably one.

The drive means preferably includes a rotation mechanism for rotating the lapping surface plate and a swing mechanism for pressing the respective divided surfaces of the bar against the processing surface of the lapping surface plate while holding the jig and swinging the jig in a direction perpendicular to the rotating direction of the lapping surface plate; and the bar is preferably mounted on the jig so that the longitudinal direction of the bar is in agreement with the swing direction of the jig.

In the above crown forming apparatus, a dummy bar, which has the same shape as that of the bar and is composed of the same material as that of the bar, is preferably bonded to the convex surface of the jig spaced apart from the bar in parallel with the longitudinal direction thereof.

When the radius of curvature of processing surface is represented by $R_2$ and the radius of curvature of the convex surface is represented by $R_1$, the relationship therebetween is preferably $R_1 \geqq R_2$.

BRIEF DESCRIPTION OF THE DRAWINGS

FIG. 2 is a view showing a lapping surface plate as an embodiment of the present invention, wherein FIG. 1A is a perspective view of the lapping surface plate and FIG. 1B is a side elevational view in section thereof.

FIG. 4 is a perspective view showing a jig of the crown forming apparatus as the embodiment of the present, invention, wherein

FIG. 11 is a view showing the jig of the crown forming apparatus as the embodiment of the present invention, wherein

FIG. 20 is a view showing the relationship between the position where a magnetic head element is disposed and the height of the crown of a bar when $R_2>R_1$, wherein

FIG. 21 is a view showing the relationship between the position where a magnetic head element is disposed and the height of the crown of a bar when $R_2=R_1$, wherein

FIG. 22 is a view showing the relationship between the height of a groove and the shape of a crown, wherein

FIG. 23 is a view showing the relationship between the width of a groove and the shape of a crown, wherein

FIG. 24 is a view showing the relationship between the roughness of a grindstone for forming a groove and the shape of a crown, wherein

DESCRIPTION OF THE PREFERRED EMBODIMENTS

A crown forming method and a crown forming apparatus for forming a crown on a floating type magnetic head as embodiments of the present invention will be described below with reference to the accompanying drawings.

First, a first example will be described in detail.

Figure 1:
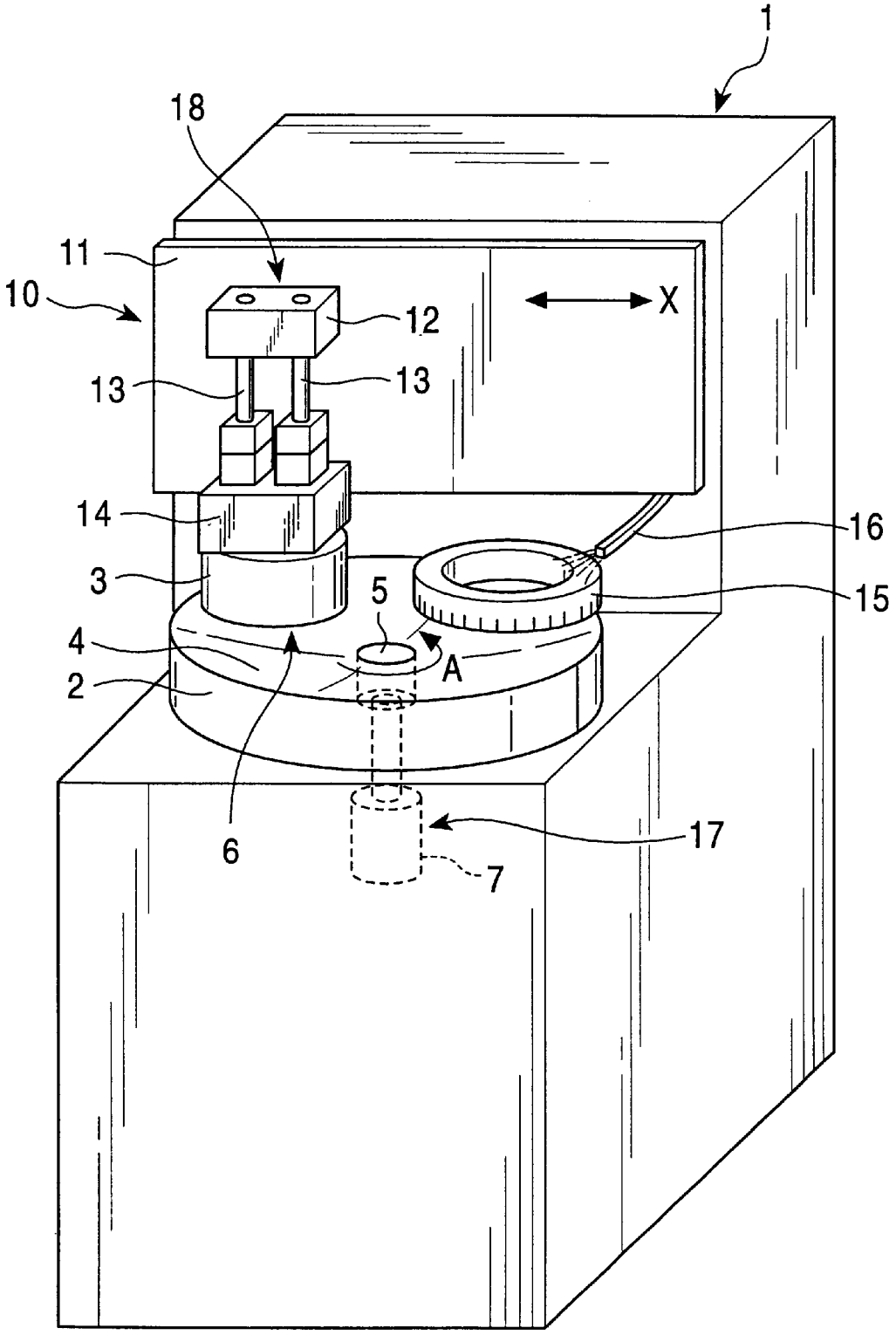
FIG. 1 is a perspective view showing a crown forming apparatus as an embodiment of the present invention.

FIG. 1 is shows a crown forming apparatus 1 according to the present invention. The crown forming apparatus 1 mainly comprises a lapping surface plate 2 disposed on a table T. a jig 3 disposed on the lapping surface plate 2, a drive means 10, a control console S standing behind the lapping surface plate 2, a swing plate 11 supported by the control console S, a polishing fluid ejecting nozzle 16 and a correction ring 15.

Figure 2A:
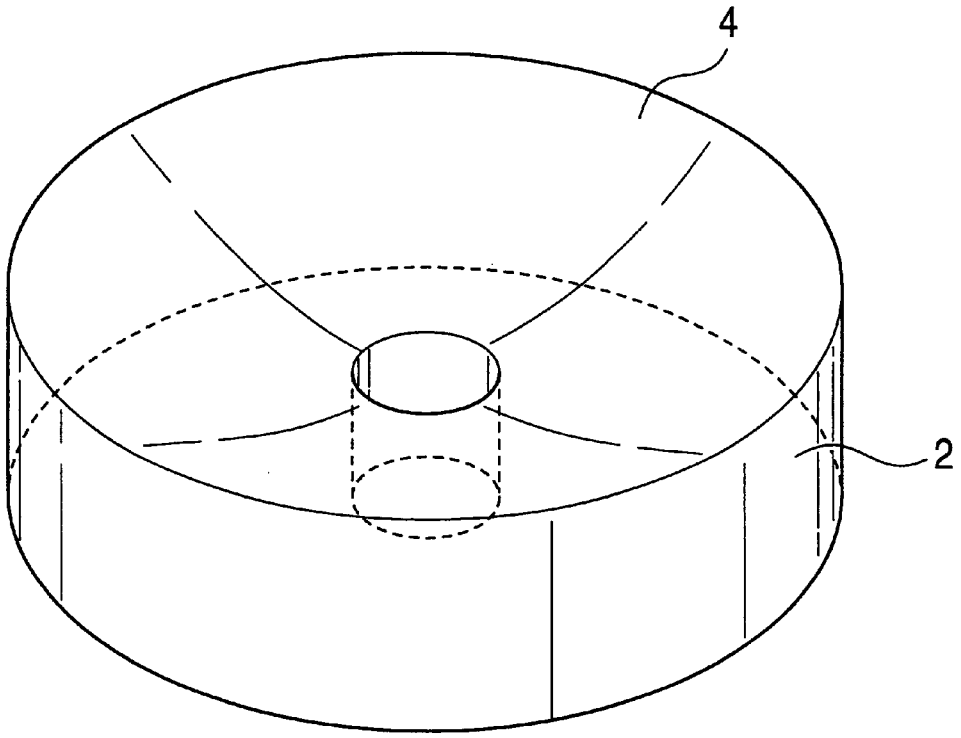
Figure 2B:
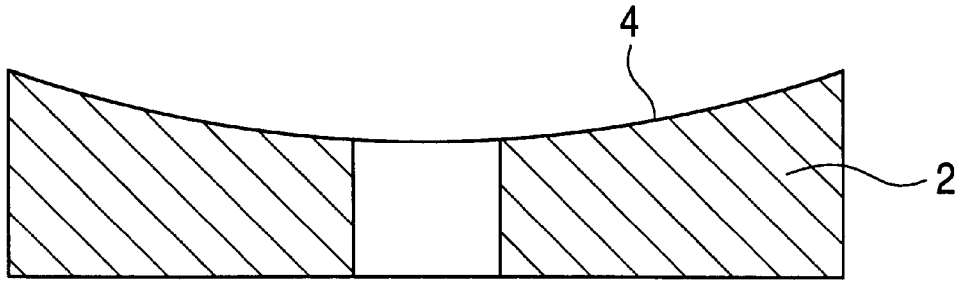

As shown FIG. 2A and FIG. 2B, the lapping surface plate 2 has an approximately disc shape as a whole and the upper surface thereof is arranged as a concave processing surface 4. The processing surface 4 is tilted downward toward the center of the lapping surface plate 2.

Figure 3:
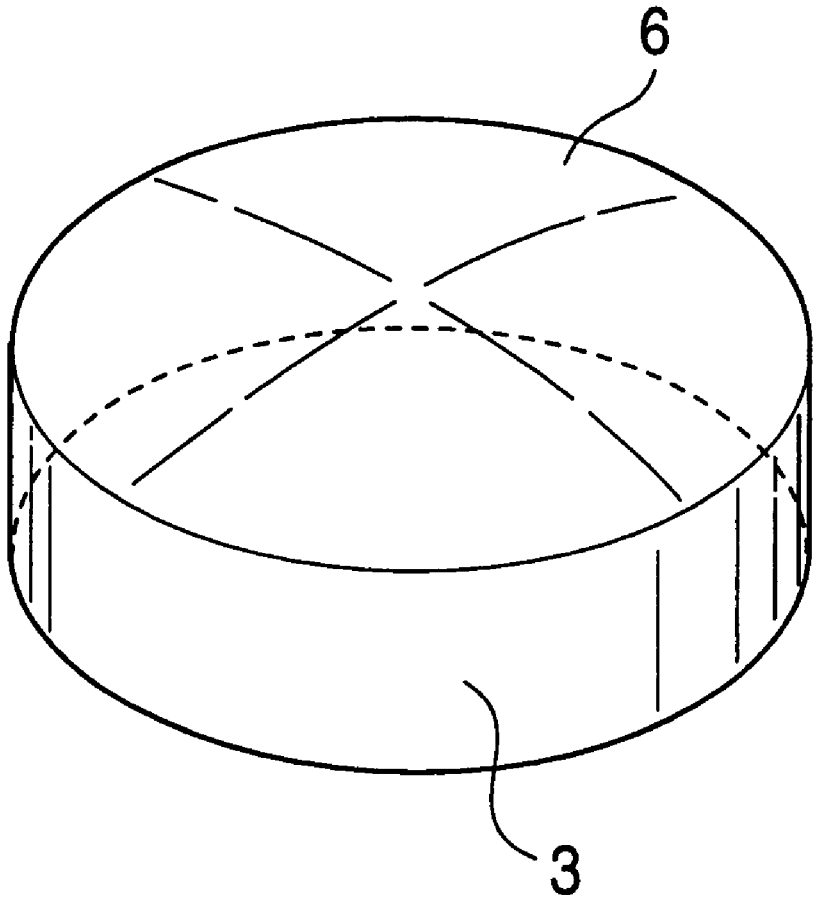
FIG. 3 is a perspective view showing a jig of the crown forming apparatus as the embodiment of the present invention.

As shown in FIG. 3, the jig 3 is formed to a columnar shape and the upper surface thereof is arranged as a convex surface 6.

Figure 4A:
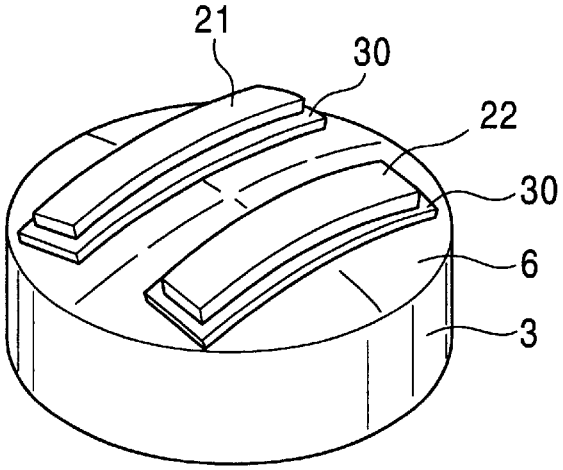
FIG. 4A is a perspective view of the jig.
Figure 4B:
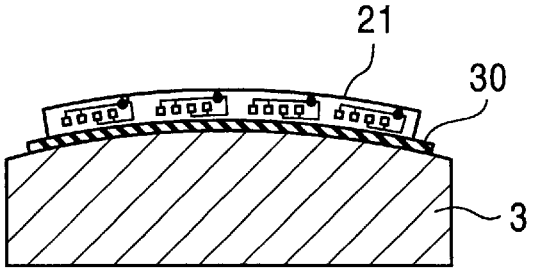
FIG. 4B is a front elevational view in section thereof and FIG. 4C is a side elevational view in section thereof.
Figure 4C:
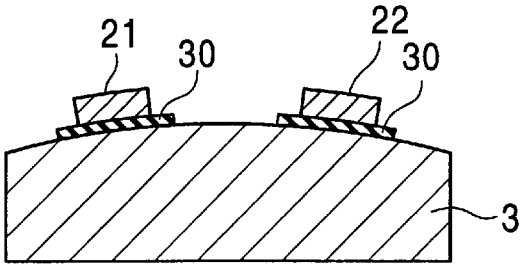

Further, as shown in FIG. 4A–FIG. 4C, a bar 21 is mounted on the convex surface 6.

The bar 21 is made in such a manner that after a multiplicity of magnetic head elements are formed on a surface of a wafer composed of a material of the slider of a floating type magnetic head using a thin film forming technology or the like, a portion of the wafer is cut to a rectangular-prism-shape.

Figure 5C:
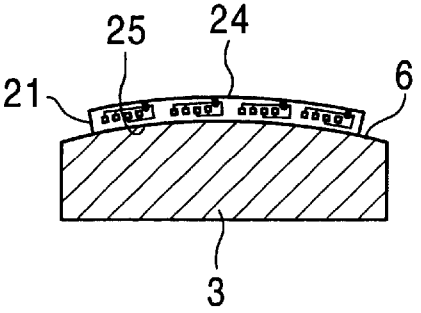
FIG. 5 is a view explaining a process for mounting a bar on the jig.
Figure 5B:
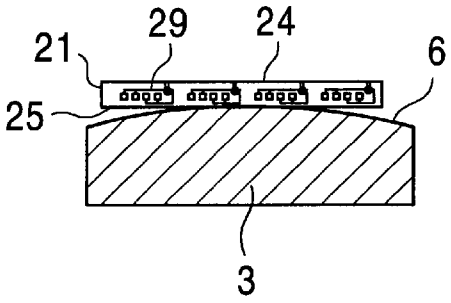
Figure 5A:
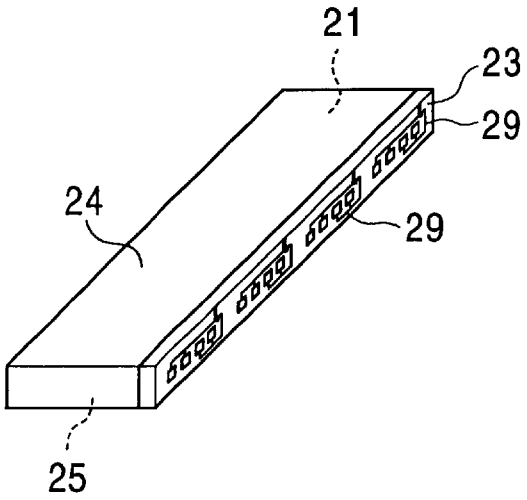

As shown in FIG. 5A, the bar 21 is cut from a wafer so that a plurality of magnetic head elements 29 . . . are disposed on a side wall 23 thereof in a row. The upper surface (surface to be processed) 24 of the bar 21, which is in contact with the side wall 23 thereof, acts as the floating surface of a floating type magnetic head obtained finally.

As shown in FIG. 5B and FIG. 5C, the bar 21 is deformed to an arc shape along the longitudinal direction of the bar 21 and bonded to the jig 3 with the upper surface (surface to be processed) 24 thereof facing upward and the lower surface 25 thereof, which is confronted with the upper surface 24, facing downward. It is preferable to preheat the bar 21 to deform it.

As shown in FIG. 4A, a dummy bar 22, which has the same shape as that of the bar 21 and is composed of the same material as that of the bar 21, is bonded to the convex surface 6 of the jig 3 spaced apart from the bar 21 in parallel with the longitudinal direction thereof.

As shown in FIG. 4A, elastic sheets 30 may be interposed between the bar 21 and the dummy bar 22 and the convex surface 6. Since each elastic sheet 30 is composed of, for example, urethane and has an adhesive surface, the bar 21 can be fixed to the convex surface 6 thereby.

Further, the elastic sheets 30 may be omitted. At the time, the bar 21 and the dummy bar 22 are fixed to the convex surface 6 through an adhesive, wax or the like.

The radius of curvature of the processing surface 4 of the lapping surface plate 2 is made equal to that of the convex surface 6 of the jig 3.

As shown in FIG. 1, the drive means 10 comprises a rotation mechanism 17 for rotating the lapping surface plate 2 and a swing mechanism 18 for pressing the jig 3 against the processing surface 4 of the lapping surface plate 2 and swinging the jig 3 in a direction perpendicular to the rotating direction of the lapping surface plate 2.

Any mechanism may be used as the rotation mechanism 17 so long as it can rotate the lapping surface plate 2. For example, the rotation mechanism 17 may be a motor 7 coupled with the lapping surface plate 2 at the center thereof and rotates the lapping surface plate 2 in the direction of an arrow A as shown in FIG. 1.

The swing mechanism 18 comprises the swing plate 11 disposed on the front surface side of the control console S, a convex unit 12 disposed on the front surface side of the swing plate 11 at an upper portion thereof, a pair of right and left load bars 13 and 13 projecting downward from the convex unit 12, and a load block 14 suspended from the load bars 13 and 13.

Figure 18:
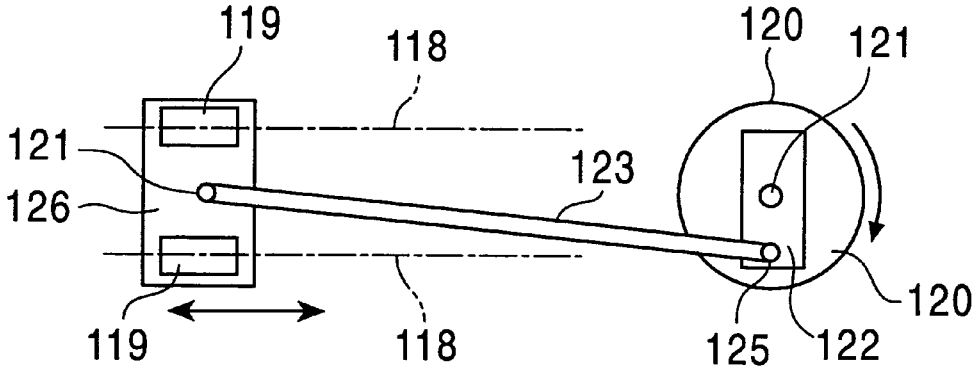
FIG. 18 is a schematic view showing the main portion of the drive mechanism of the crown forming apparatus as the embodiment of the present invention.
Figures 19A, 19B, 19C, 19D, 19E, 19F:
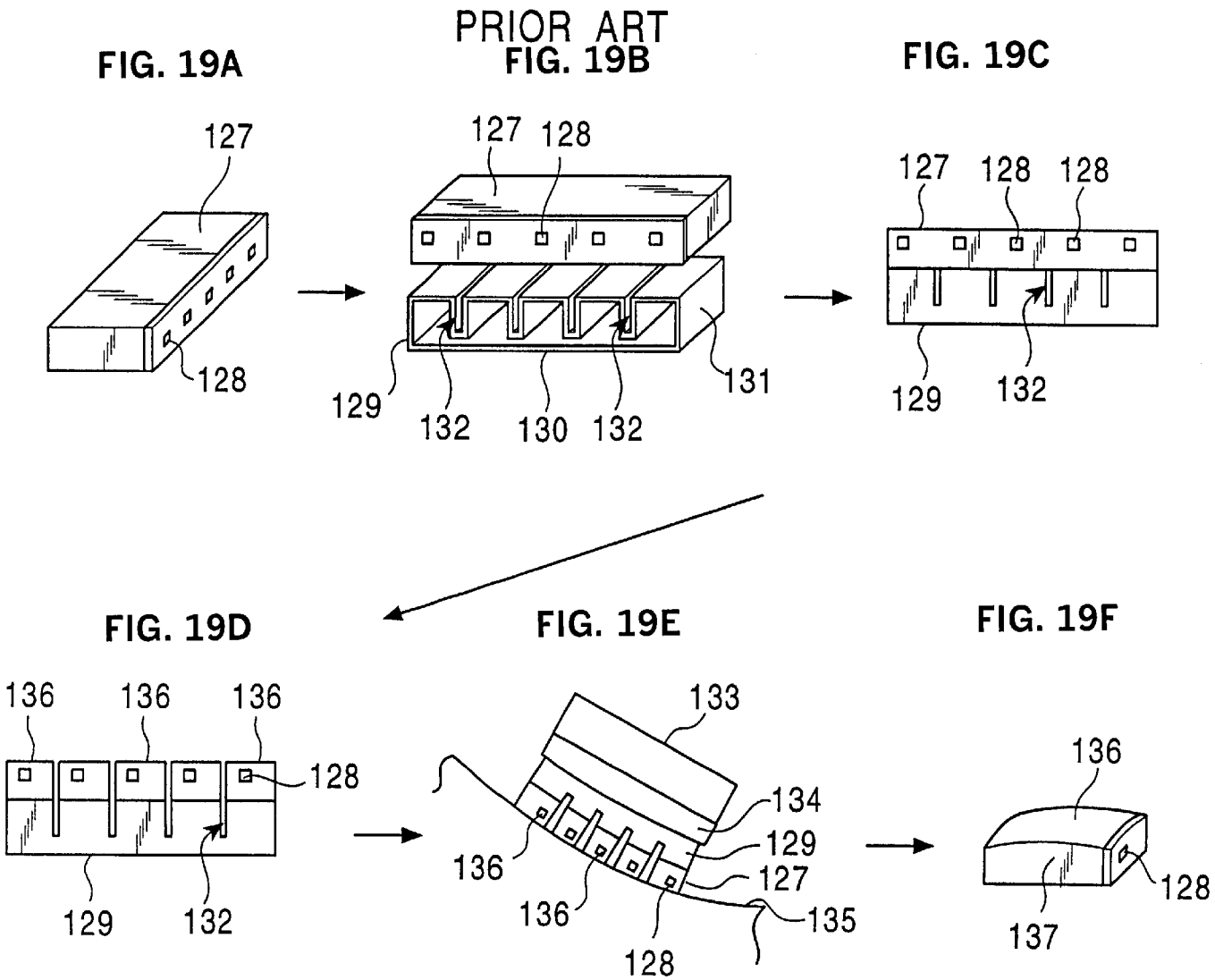
PRIOR ART FIG. 19B
FIGS. 19A–19F is a process view explaining a fourth example of conventional methods of forming a crown on a floating type magnetic head.

A support surface 19 is disposed to the back surface side of the swing plate 11 as shown in FIG. 1, and rail members 118 and 118 shown in FIG. 18 are attached to the support surface 19 on the front surface thereof on the lapping surface plate 2 side, and rail receiving units 119 and 119 are disposed so as to be engaged with the rail members 118 and 118. The rail receiving units 119 and 119 are connected to the back surface of the swing plate 11 so that the swing plate 11 can reciprocate right and left along the rail members 118 and 118.

As shown in FIG. 18, a motor 120 and a link arm 123 are disposed on the front surface side of the support surface 19 between the swing plate 11 and the support surface 19. An end of the link arm 123 is rotatably coupled with an end of an arm plate 122 mounted on the rotatable shaft 121 of the motor 120 through a pin 125 and the other end of the link arm 123 is rotatably coupled with a drive plate 126 at the center thereof through a pin 127 as well as the rail receiving units 119 and 119 are mounted on the drive plate 126 on the upper and lower sides thereof, respectively.

With the above arrangement, the arm plate 122 is rotated by the rotation of the motor 120, whereby the link arm 123 is eccentically rotated at an end thereof as well as the other end of the link arm 123 is reciprocated right and left along the rail members 118 and 118. As a result, the swing plate 11 can swing in the direction of an arrow X in FIG. 1.

As shown in FIG. 1, the jig 3 is mounted on a load block 14 so that the convex surface 6 is confronted with the processing surface 4 of the lapping surface plate 2 and urged toward the lapping surface plate 2 by elastic members (not shown) build into the load bars 13 and 13. With this arrangement, the bar 21 and the dummy bar 22 are pressed against the processing surface 4.

Figure 6:
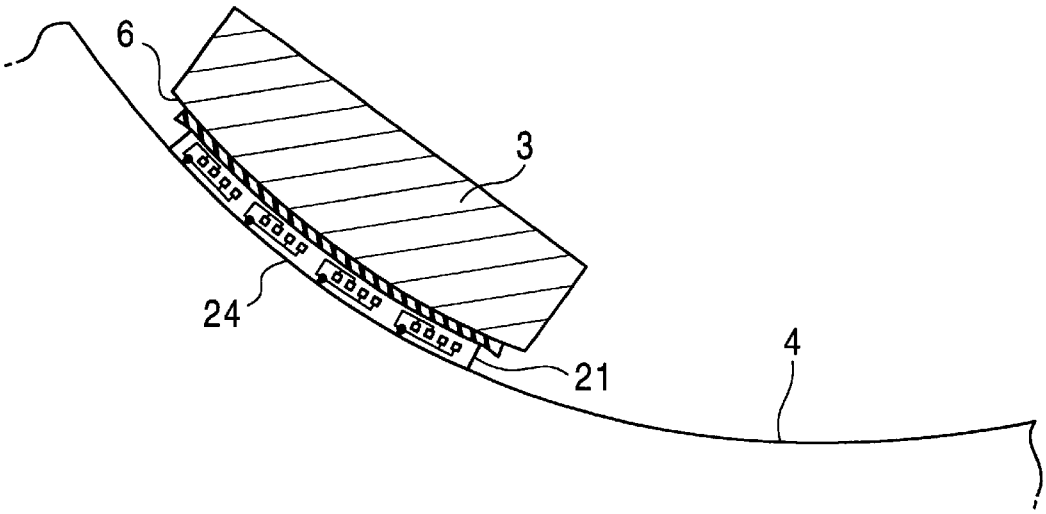
FIG. 6 is a front elevational view in section showing the main portion of the crown forming apparatus as the embodiment of the present invention.
Figure 7:
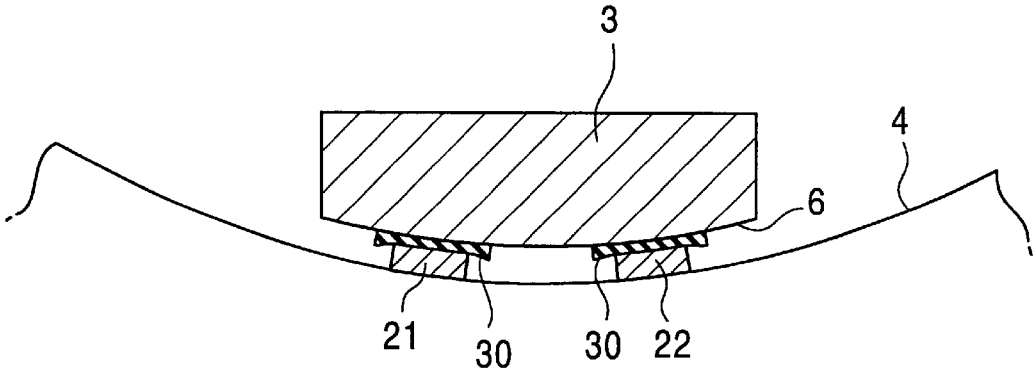
FIG. 7 is a side elevational view in section showing the main portion of the crown forming apparatus as the embodiment of the present invention.

As shown in FIGS. 6 and 7, the jig 3 is disposed on the processing surface 4 so that the upper surface (surface to be processed) 24 of the bar 21 is abutted against the processing surface 4 of the lapping surface plate 2.

Further, it is preferable that the bar 21 and the dummy bar 22 are mounted on the jig 3 such that the longitudinal directions thereof are in agreement with the swinging direction of the jig 3.

As shown in FIG. 1, the polishing fluid ejecting nozzle 16 ejects a polishing fluid toward the processing surface 4 of the lapping surface plate 2.

The correction ring 15 is abutted against and fixed to the processing surface 4 of the lapping surface plate 2. The correction ring 15 is caused to slide on the processing surface 4 by the rotation of the lapping surface plate 2, whereby the polishing fluid can be uniformly sprayed onto the entire processing surface 4.

The following operation will be executed to form a crown on the upper surface (surface to be processed) 24 of the bar 21 using the above crown forming apparatus 1.

First, the polishing fluid is sprayed onto the processing surface 4 from the polishing fluid ejecting nozzle 16.

Next, the lapping surface plate 2 is rotated, the bar 21 and the dummy bar 22, which are mounted on the jig 3, are swung in the direction perpendicular to the rotating direction of the lapping surface plate 2 while being abutted again the processing surface 4 by the swing mechanism 18. As a result, the bar 21 and the dummy bar 22 are moved relative to the processing surface 4, and the upper surface (surface to be processed) 24 of the bar 21 and the upper surface of the dummy bar 22 are caused to slide on the processing surface 4, whereby the upper surface 24 of the bar 21 is lapped.

At the time, the dummy bar 22 is also lapped by the processing surface 4 similarly to the bar 21.

The main portion of the crown forming apparatus 1 is shown in FIGS. 4, 5 and 6.

As shown in FIGS. 4A and 4B, when the bar 21 is mounted on the jig 3, it can be easily deformed to an arc-shape along the longitudinal direction thereof and comes into intimate contact with the convex surface 6 of the jig 3. Accordingly, the upper surface 24 of the bar 21 is curved along the longitudinal direction thereof and the radius of curvature of the curved upper surface 24 is made larger than the radius of curvature of the convex surface 6 by the thicknesses of the bar 21 and the elastic sheet 30.

Since the radius of curvature of the convex surface 6 is the same as that of the processing surface 4, the radius of curvature of the upper surface 24 of the bar 21 is made larger than that of the processing surface 4.

Next, when the bar 21 is pressed against the processing surface 4 as shown in FIG. 6, both the ends of the bar 21 in the longitudinal direction thereof are pressed against the processing surface 4 and the elastic sheets 30 is deformed so that the radius of curvature of the upper surface 24 is made approximately equal to that of the processing surface 4.

Further, when the bar 21 is directly mounted on the convex surface 6 by means of an adhesive, wax or the like without using the elastic sheets 30, both the ends of the bar 21 in the longitudinal direction thereof are pressed against the processing surface 4 and deformed at the time the bar 21 is pressed against the processing surface 4 so that the radius of curvature of the upper surface 24 is made approximately equal to that of the processing surface 4.

Since the radius of curvature of the upper surface 24 of the bar 21 is made approximately equal to that of the processing surface 4 in the longitudinal direction of the bar 21 and the bar 21 is swung in a direction parallel with the longitudinal direction of the bar 21 by the jig 3, the bar 21 is uniformly lapped in the longitudinal direction thereof.

Next, the upper surface 24 of the bar 21 is made flat in the short direction thereof because the bar 21 is rigid in the short direction thereof and it is difficult for the bar 21 to be flexed in that direction as shown in FIGS. 4C and 7.

Figure 8:
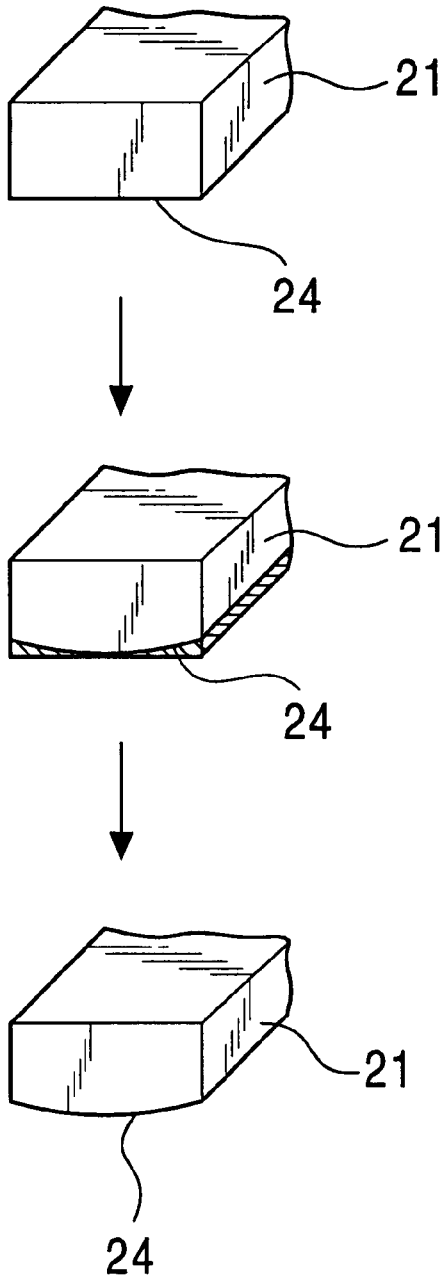
FIG. 8 is a view explaining a process for subjecting a bar to lapping.

Accordingly, both the ends of the upper surface 24 of the bar 21 in the short direction thereof (the diagonally shaded areas in FIG. 8) are lapped by being polished with abrasive grains similarly to the above mentioned as shown in FIG. 8 so that the upper surface 24 is formed to a convex surface in the short direction. At the time, since concave surface of the processing surface 4 is transferred onto the upper surface 24 of the bar 21 in the lapping, the radius of curvature of the upper surface 24 in the short direction thereof is made approximately equal to that of the processing surface.

Figure 9A:
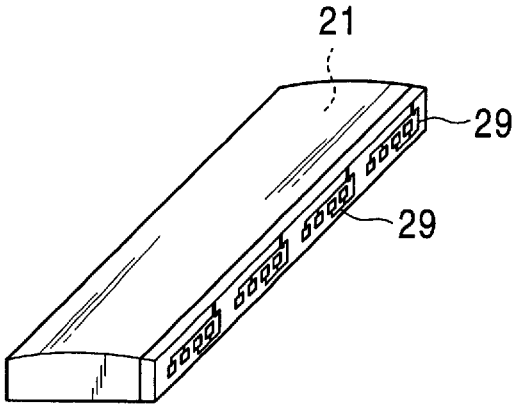
FIG. 9 is a view explaining a process for obtaining a floating type magnetic head from the bar.

As described above, the upper surface 24 of the bar 21 having been lapped is formed to a convex surface which is made convex in the short direction of the bar 21 as shown in FIG. 9A.

Figure 9B:
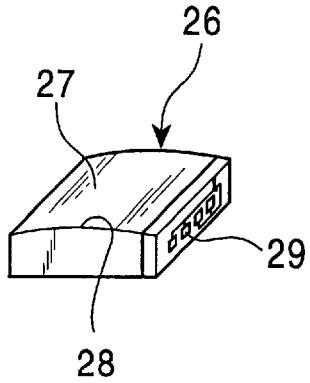

A floating type magnetic head 26 can be obtained by cutting off the bar 21 in the longitudinal direction thereof at equal intervals (FIG. 9B). The floating surface 27 of the floating type magnetic head 26 is composed of the upper surface 24 of the bar 21 and a crown 28 having the same radius of curvature as that of the processing surface 4 is formed on the floating surface 27.

In the above method of forming the crown of a floating type magnetic head, the bar 21 having the plurality of magnetic head elements disposed thereto in a row is mounted on the convex surface 6 of the jig 3 and lapped by being pressed against the concave processing surface 4. Accordingly, the floating surfaces of a plurality of floating type magnetic heads can be simultaneously lapped, whereby the productivity of the floating type magnetic head can be enhanced.

In the above method of forming the crown of a floating type magnetic head, the radius of curvature of the processing surface 4 of the lapping surface plate 2 is the same as that of the convex surface 6 of the jig 3. Accordingly, when the bar 21 is pressed against the processing surface 4, both the ends of the bar 21 are pressed against the processing surface 4 at all times, whereby lapping can be executed while deforming the bar 21 to the arc-shape at all times.

Further, in the above method of forming the crown of a floating type magnetic head, when the bar 21 is pressed against the processing surface 4, the radius of curvature of the upper surface (surface to be processed) 24 of the bar 21 in the longitudinal direction thereof can be made equal to the radius of curvature of the processing surface 4 by elastically deforming the bar 21 along the convex surface 6 of the jig 3. Accordingly, the upper surface 24 of the bar 21 can be uniformly lapped in the longitudinal direction of the bar 21 as well as a convex surface whose radius of curvature is the same as that of the processing surface 4 can be formed on the bar 21 in the short direction thereof.

Further, since the convex surface of the bar 21 is formed by the transfer of the shape of the processing surface 4 thereto, crowns excellent in a dimensional accuracy of shape can be obtained.

In the above method of forming the crown of a floating type magnetic head, the lapping surface plate 2 is rotated as well as the jig 3 is swung in the direction perpendicular to the rotating direction of the lapping surface plate 2 to thereby move the bar 21 relative to the processing surface 4. Accordingly, the bar 21 can be effectively lapped.

Since the bar 21 is swung in the direction perpendicular to the rotating direction of the lapping surface plate 2, no scratches remain on the upper surface (surface to be processed) 24 of the bar 21 along the rotating direction of the lapping surface plate 2.

Since the bar 21 is lapped while being in uniform contact with the entire surface of the processing surface 4 by swinging the jig 3 in the direction perpendicular to the rotating direction of the lapping surface plate 2, the processing surface 4 is not partly worn eccentrically, whereby the entire surface of the processing surface 4 can be uniformly worn and the deformation thereof can be prevented.

Further, in the above method of forming the crown of a floating type magnetic head, the bar 21 and the dummy bar 22 are mounted on the jig 3 in parallel with each other in the longitudinal directions thereof and they are pressed against the processing surface 4 at all times. Accordingly, the bar 21 can be lapped while being stably in contact with the processing surface 4 in the short direction thereof, whereby crowns excellent in a dimensional accuracy of shape can be formed.

Since the above crown forming apparatus 1 comprises the jig 3, on which the bar 21 having the plurality of magnetic head elements disposed thereto in a row is mounted, the lapping surface plate 2 having the processing surface 4 formed to the concave shape and the drive means 10, it can lap the floating surfaces of a plurality of floating type magnetic heads at the same time.

Since the jig 3 has the convex surface 6, it can hold the bar 21 while deforming it in the arc shape in the longitudinal direction thereof, whereby the crown, which is convex along the short direction of the bar 21 can be formed on the upper surface 24 thereof.

In the above crown forming apparatus 1, since the radius of curvature of the processing surface 4 of the lapping surface plate 2 is the same as that of the convex surface 6 of the jig 3, both the ends of the bar 21 are pressed against the processing surface 4 at all times when bar 21 is pressed against the processing surface 4. Accordingly, the crown forming apparatus 1 can lap the bar 21 while deforming it to the arc-shape at all times. Further, since the convex surface of the bar 21 is formed by the transfer of the shape of the processing surface 4 to the upper surface 24 of the bar 21 in the short direction thereof, crowns excellent in a dimensional accuracy of shape can be formed.

Since the crown forming apparatus 1 is provided with the drive means 10 for rotating the lapping surface plate 2 as well as swinging the jig 3 in the direction perpendicular to the rotating direction of the lapping surface plate 2, the apparatus 1 can effectively execute lapping.

Since the bar 21 is swung in the longitudinal direction thereof, lapping can be uniformly executed to the bar 21 in the longitudinal direction thereof.

Since the bar 21 is swung in the direction perpendicular to the rotating direction of the lapping surface plate 2, no scratches remains on the upper surface (surface to be processed) 24 of the bar 21 along the rotating direction of the lapping surface plate 2.

Since the bar 21 is lapped while being in uniform contact with the entire surface of the processing surface 4 by swinging the jig 3 in the direction perpendicular to the rotating direction of the lapping surface plate 2, the processing surface 4 is not partly worn eccentrically, whereby the entire surface of the processing surface 4 can be uniformly worn and the deformation thereof can be prevented.

Further, in the above crown forming apparatus 1, since the bar 21 and the dummy bar 22 are mounted on the jig 3 in parallel with each other in the longitudinal directions thereof, the bar 21 is stably in contact with the processing surface 4 in the short direction thereof without being swung in the short direction thereof, whereby crowns excellent in a dimensional accuracy of shape can be formed.

Next, a second example will be described below in detail.

FIG. 1 is shows a crown forming apparatus 1 according to the present invention. The crown forming apparatus 1 mainly comprises a lapping surface plate 2 disposed on a table T, a jig 3 disposed on the lapping surface plate 2, a drive means 10, a control console S standing behind the lapping surface plate 2, a swing plate 11 supported by the control console S, a polishing fluid ejecting nozzle 16 and a correction ring 15.

As shown FIG. 2A and FIG. 2B, the lapping surface plate 2 has an approximately disc shape as a whole and the upper surface thereof is arranged as a concave processing surface 4. The processing surface 4 is tilted downward toward the center of the lapping surface plate 2.

As shown in FIG. 3, the jig 3 is formed to a columnar shape and the upper surface thereof is arranged as a convex surface 6.

Further, as shown in FIG. 4A–FIG. 4C, a bar 21 is mounted on the convex surface 6.

The bar 21 is made in such a manner that after a multiplicity of magnetic head elements are formed on a surface of a wafer composed of a material of the slider of a floating type magnetic head using a thin film forming technology or the like, a portion of the wafer is cut to a rectangular-prism-shape.

As shown in FIG. 5A, the bar 21 is cut from a wafer so that a plurality of magnetic head elements 29 . . . are disposed on a side wall 23 thereof in a row. The upper surface (surface to be processed) 24 of the bar 21, which is in contact with the side wall 23 thereof, acts as the floating surface of a floating type magnetic head obtained finally.

As shown in FIG. SB and FIG. 5C, the bar 21 is deformed to an arc shape along the longitudinal direction of the bar 21 and bonded to the jig 3 with the upper surface (surface to be processed) 24 thereof facing upward and the lower surface 25 thereof, which is confronted with the upper surface 24, facing downward. It is preferable to preheat the bar 21 to deform it.

As shown in FIG. 4A, a dummy bar 22, which has the same shape as that of the bar 21 and is composed of the same material as that of the bar 21, is bonded to the convex surface 6 of the jig 3 spaced apart from the bar 21 in parallel with the longitudinal direction thereof.

As shown in FIG. 4A, elastic sheets 30 are interposed between the bar 21 and the dummy bar 22 and the convex surface 6. Since each elastic sheet 30 is composed of, for example, urethane and has an adhesive surface, the bar 21 can be fixed to the convex surface 6 thereby.

Further, the hardness (Japanese Industrial Standard A) of the elastic sheets 30 is preferably not less than 6 to not more than 40 and more preferably not less than 10 to not more than 20. Further, the thickness of the elastic sheets 30 is preferably not less than 0.1 mm to not more than 3 mm and more preferably not less than 0.5 mm to not more than 1 mm.

The relationship between the radius of curvature $R_1$ of the processing surface 4 of the lapping surface plate 2 and the radius of curvature $R_2$ of the convex surface 6 of the jig 3 is made to $R_1 \geqq R_2$.

As shown in FIG. 1, the drive means 10 comprises a rotation mechanism 17 for rotating the lapping surface plate 2 and a swing mechanism 18 for pressing the jig 3 against the processing surface 4 of the lapping surface plate 2 and swinging the jig 3 in a direction perpendicular to the rotating direction of the lapping surface plate 2.

Any mechanism may be used as the rotation mechanism 17 so long as it can rotate the lapping surface plate 2. For example, the rotation mechanism 17 may be a motor 7 coupled with the lapping surface plate 2 at the center thereof and rotates the lapping surface plate 2 in the direction of an arrow A as shown in FIG. 1.

The swing mechanism 18 comprises the swing plate 11 disposed on the front surface side of the control console S, a convex unit 12 disposed on the front surface side of the swing plate 11 at an upper portion thereof, a pair of right and left load bars 13 and 13 projecting downward from the convex unit 12, and a load block 14 suspended from the load bars 13 and 13.

Figure 15:
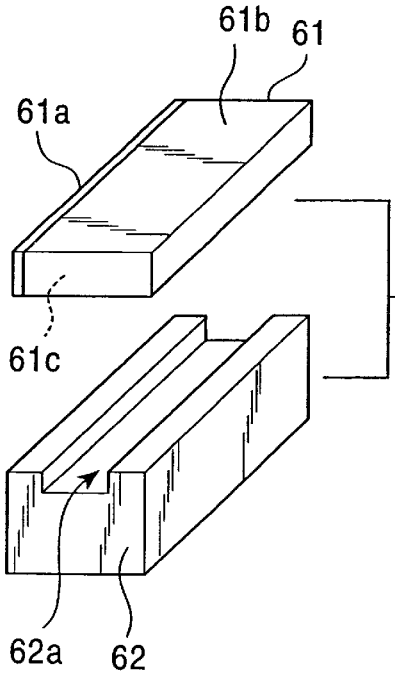
FIG. 15 A PRIOR ART
FIGS. 15A–15E is a process view explaining a first example of conventional methods of forming a crown on a floating type magnetic head.
Figure 15B:
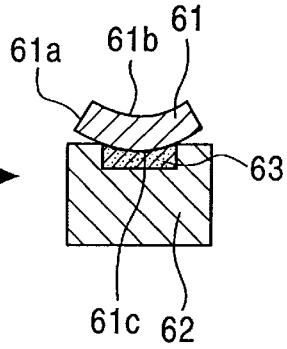
Figure 15C:
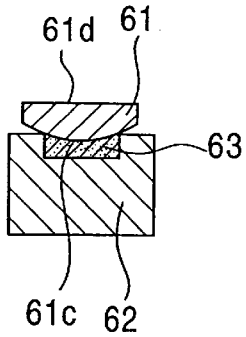
Figure 15D:
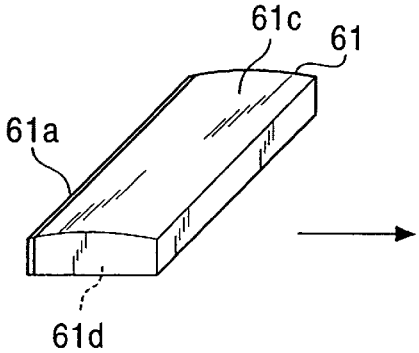
Figure 15E:
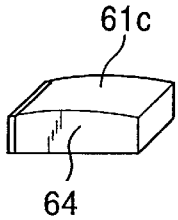
Figure 16A:
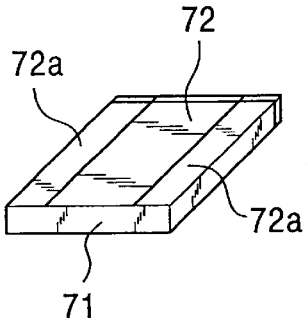
PRIOR ART FIG. 16A
FIGS. 16A–16C is a process view explaining a second example of conventional methods of forming a crown on a floating type magnetic head.
Figure 16B:
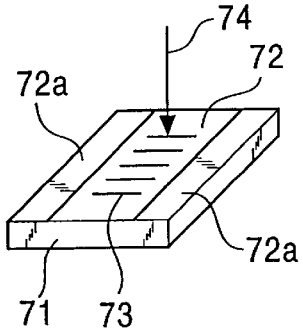
Figure 16C:
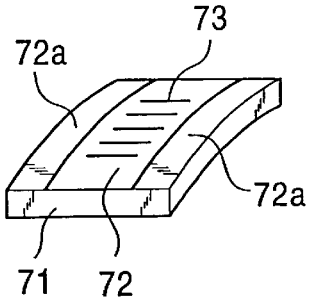
Figures 17A, 17B, 17C, 17D, 17E:
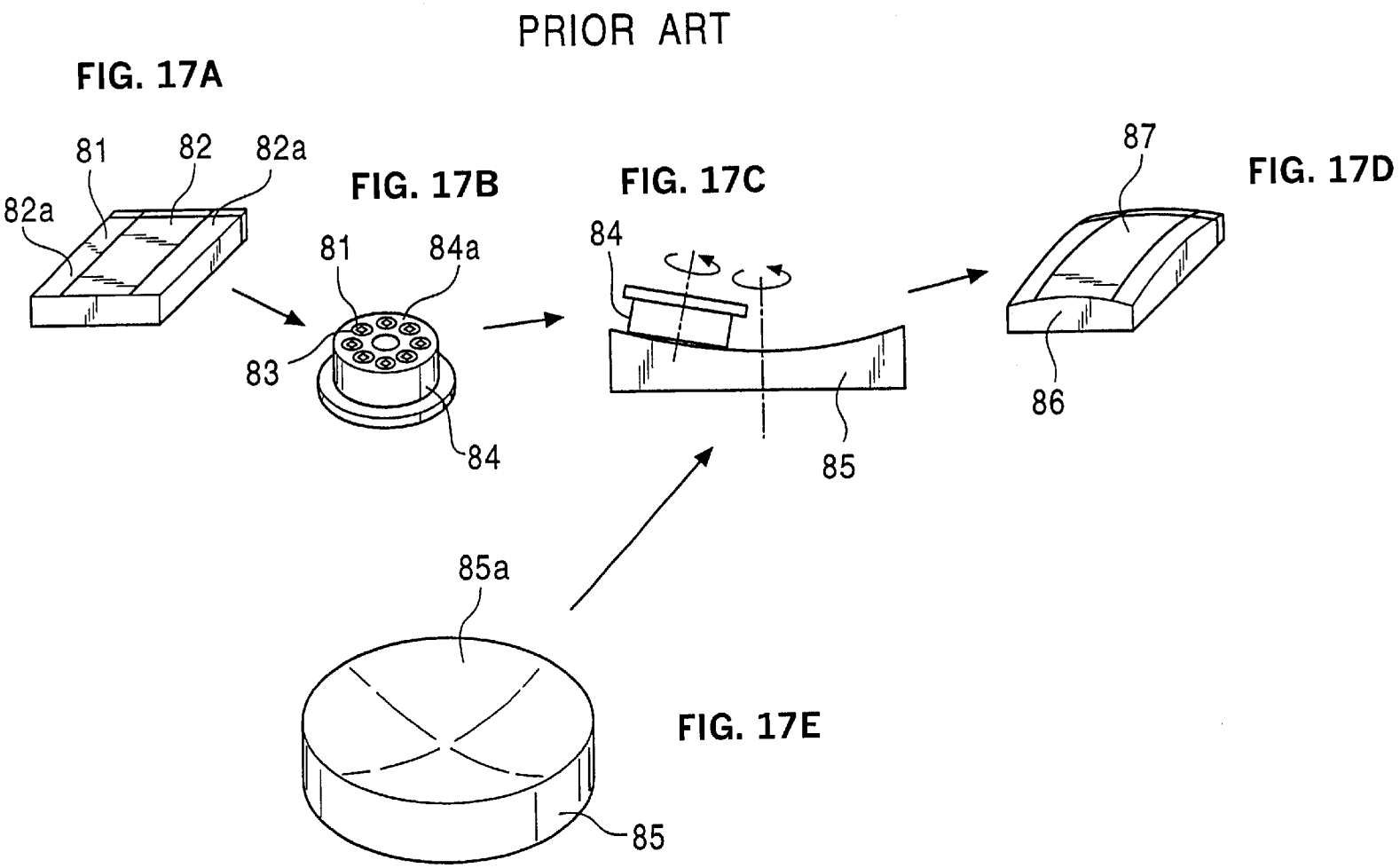
PRIOR ART FIG. 17A
FIGS. 17A–17E is a process view explaining a third example of conventional methods of forming a crown on a floating type magnetic head.

A support surface 19 is disposed to the back surface side of the swing plate 11 as shown in FIG. 1, and rail members 118 and 118 shown in FIG. 15 are attached to the support surface 19 on the front surface thereof on the lapping surface plate 2 side, and rail receiving units 119 and 119 are disposed so as to be engaged with the rail members 118 and 118. The rail receiving units 119 and 119 are connected to the back surface of the swing plate 11 so that the swing plate 11 can reciprocate right and left along the rail members 118 and 118.

As shown in FIG. 15, a motor 120 and a link arm 123 are disposed on the front surface side of the support surface 19 between the swing plate 11 and the support surface 19. An end of the link arm 123 is rotatably coupled with an end of an arm plate 122 mounted on the rotatable shaft 121 of the motor 120 through a pin 125 and the other end of the link arm 123 is rotatably coupled with a drive plate 126 at the center thereof through a pin 127 as well as the rail receiving units 119 and 119 are mounted on the drive plate 126 on the upper and lower sides thereof, respectively.

With the above arrangement, the arm plate 122 is rotated by the rotation of the motor 120, whereby the link arm 123 is eccentically rotated at an end thereof as well as the other end of the link arm 123 is reciprocated right and left along the rail members 118 and 118. As a result, the swing plate 11 can swing in the direction of an arrow X in FIG. 1.

As shown in FIG. 1, the jig 3 is mounted on a load block 14 so that the convex surface 6 is confronted with the processing surface 4 of the lapping surface plate 2 and urged toward the lapping surface plate 2 by elastic members (not shown) build into the load bars 13 and 13. With this arrangement, the bar 21 and the dummy bar 22 are pressed against the processing surface 4.

As shown in FIGS. 6 and 7, the jig 3 is disposed on the processing surface 4 so that the upper surface (surface to be processed) 24 of the bar 21 is abutted against the processing surface 4 of the lapping surface plate 2.

Further, it is preferable that the bar 21 and the dummy bar 22 are mounted on the jig 3 such that the longitudinal directions thereof are in agreement with the swinging direction of the jig 3.

As shown in FIG. 1, the polishing fluid ejecting nozzle 16 ejects a polishing fluid toward the processing surface 4 of the lapping surface plate 2. The polishing fluid contains, for example, diamond abrasive grains or the like.

The correction ring 15 is abutted against and fixed to the processing surface 4 of the lapping surface plate 2. The correction ring 15 is caused to slide on the processing surface 4 by the rotation of the lapping surface plate 2, whereby the polishing fluid can be uniformly sprayed onto the entire processing surface 4.

The following operation will be executed to form a crown on the upper surface (surface to be processed) 24 of the bar 21 using the above crown forming apparatus 1.

First, the polishing fluid is sprayed onto the processing surface 4 from the polishing fluid ejecting nozzle 16.

Next, the lapping surface plate 2 is rotated, the bar 21 and the dummy bar 22, which are mounted on the jig 3, are swung in the direction perpendicular to the rotating direction of the lapping surface plate 2 while being abutted again the processing surface 4 by the swing mechanism 18. As a result, the bar 21 and the dummy bar 22 are moved relative to the processing surface 4, and the upper surface (surface to be processed) 24 of the bar 21 and the upper surface of the dummy bar 22 are caused to slide on the processing surface 4, whereby the upper surface 24 is lapped.

At the time, the dummy bar 22 is also lapped by the processing surface 4 similarly to the bar 21.

The main portion of the crown forming apparatus 1 is shown in FIGS. 4, 5 and 6.

As shown in FIGS. 4A and 4B, when the bar 21 is mounted on the jig 3, it can be easily deformed to an arc-shape along the longitudinal direction thereof and comes into intimate contact with the convex surface 6 of the jig 3. Accordingly, the upper surface 24 of the bar 21 is curved along the longitudinal direction thereof and the radius of curvature of the curved upper surface 24 is made larger than the radius of curvature of the convex surface 6 by the thicknesses of the bar 21 and the elastic sheet 30.

Further, since the radius of curvature of the convex surface 6 is larger than that of the processing surface 4, the radius of curvature of the upper surface 24 of the bar 21 is made larger than that of the processing surface 4.

Next, when the bar 21 is pressed against the processing surface 4 as shown in FIG. 6, both the ends of the bar 21 in the longitudinal direction thereof are pressed against the processing surface 4 and the elastic sheets 30 is deformed so that the radius of curvature of the upper surface 24 is made approximately equal to that of the processing surface 4.

At the time, since the elastic sheets 30 is deformed so as to protrude from the bar 21 at both the ends of the bar 21, the load imposed on the bar 21 from the jig 3 is made smaller at both the ends of the bar than at the central portion thereof.

At the time, when the relationship between the radius of curvature $R_2$ of the processing surface 4 and the radius of curvature $R_1$ of the convex surface is $R_1>R_2$, both the ends of the bar 21 is pressed by the convex surface 6, whereby the upper surface 24 of the bar 21 can be entirely pressed against the processing surface 4 uniformly.

Since the radius of curvature of the upper surface 24 of the bar 21 is made approximately equal to that of the processing surface 4 in the longitudinal direction of the bar 21 and the bar 21 is swung in a direction parallel with the longitudinal direction of the bar 21 by the jig 3, the bar 21 is uniformly lapped in the longitudinal direction thereof.

The hardness (Japanese Industrial Standard A) of the elastic sheets 30 is preferably not less than 10 to not more than 20 as described above. The hardness less than 10 is not preferable because the elastic deformation of the elastic sheet 30 is increased and the elastic sheet 30 is liable to protrude from the bar 21, and thus the upper surface 24 of the bar 21 cannot be entirely pressed against the processing surface 4 uniformly. Further, the hardness exceeding 20 is not also preferable because the elastic deformation of the elastic sheet 30 is reduced, and when the bar 21 is pressed against the processing surface 4, the radius of curvature of the upper surface 24 of the bar 21 cannot be in agreement with the radius of curvature of the processing surface 4, and thus a crown, which is uniform in the longitudinal direction of the bar 21, cannot be formed.

Further, it is preferable that the thickness of the elastic sheets 30 is preferably not less than 0.1 mm to not more than 3. Since the elastic sheet 30 is too thin when the thickness thereof is less than 0.1 mm, both the ends of the bar 21 in the longitudinal direction thereof interfere with the convex surface 6, and thus the radius of curvature of the upper surface 24 of the bar 21 cannot be in agreement with the radius of curvature of the processing surface 4. In addition, the thickness of the elastic sheet 30 exceeding 3 mm is not also preferable because the elastic sheet 30 is too thick and the distance between the bar 21 and the convex surface 6 is increased, and thus the bar 21 cannot be stably deformed to the arc shape.

Next, since it is difficult for the bar 21 to be flexed in the short direction thereof because it is rigid in that as shown in FIGS. 4C and 7, the upper surface (surface to be processed) 24 is made flat in the short direction thereof.

Accordingly, both the ends of the upper surface 24 of the bar 21 in the short direction thereof (the diagonally shaded areas in FIG. 8) are lapped by being polished with abrasive grains similarly to the above mentioned as shown in FIG. 8 so that the upper surface 24 is formed to a convex surface in the short direction. At the time, since concave surface of the processing surface 4 is transferred onto the upper surface 24 of the bar 21 in the lapping, the radius of curvature of the upper surface 24 in the short direction thereof is made approximately equal to that of the processing surface.

As described above, the upper surface (surface to be processed) 24 of the bar 21 having been lapped is formed to a convex surface which is made convex in the short direction of the bar 21 as shown in FIG. 9A.

A floating type magnetic head 26 can be obtained by cutting off the bar 21 in the longitudinal direction thereof at equal intervals (FIG. 9B). The floating surface 27 of the floating type magnetic head 26 is composed of the upper surface (surface to be processed) 24 of the bar 21 and a crown 28 having the same radius of curvature as that of the processing surface 4 is formed on the floating surface 27.

In the above method of forming the crown of a floating type magnetic head, the bar 21 having the plurality of magnetic head elements disposed thereto in a row is mounted on the convex surface 6 of the jig 3 and lapped by being pressed against the concave processing surface 4. Accordingly, the floating surfaces of a plurality of floating type magnetic heads can be simultaneously lapped, whereby the productivity of the floating type magnetic head can be enhanced.

In the above method of forming the crown of a floating type magnetic head, since the radius of curvature $R_2$ of the processing surface 4 and the radius of curvature $R_1$ of the convex surface have the relationship $R_1>R_2$, both the ends of the bar 21 in the longitudinal direction thereof are pressed by the convex surface 6, whereby the upper surface (surface to be processed) 24 of the bar 21 can be entirely pressed against the processing surface 4 uniformly, and thus the bar 21 can be uniformly lapped the in longitudinal direction thereof.

When the bar 21 is pressed against the processing surface 4, both the ends of the bar 21 are pressed against the processing surface 4 at all the times so that the bar 21 can be lapped while being always deformed to the arc shape.

Further, since the convex surface of the bar 21 is formed by the transfer of the shape of the processing surface 4 thereto, crowns excellent in a dimensional accuracy of shape can be obtained.

In the above method of forming the crown of a floating type magnetic head, the lapping surface plate 2 is rotated as well. as the jig 3 is swung in the direction perpendicular to the rotating direction of the lapping surface plate 2 to thereby move the bar 21 relative to the processing surface 4. Accordingly, the bar 21 can be effectively lapped.

Further, in the above method of forming the crown of a floating type magnetic head, the bar 21 and the dummy bar 22 are bonded to the jig 3 in parallel with each other in the longitudinal directions thereof and they are pressed against the processing surface 4 at all times. Accordingly, the bar 21 can be lapped while being stably in contact with the processing surface 4 in the short direction thereof, whereby crowns excellent in a dimensional accuracy of shape can be formed.

Since the above crown forming apparatus 1 comprises the jig 3, to which the bar 21 having the plurality of magnetic head elements disposed thereto in a row is bonded, the lapping surface plate 2 having the processing surface 4 formed to the concave shape and the drive means 10, it can lap the floating surfaces of a plurality of floating type magnetic heads at the same time.

Since the jig 3 has the convex surface 6, it can hold the bar 21 while deforming it in the arc shape in the longitudinal direction thereof, whereby the crown, which is convex along the short direction of the bar 21 can be formed on the upper surface (surface to be processed) 24 thereof.

In the above crown forming apparatus 1, since the elastic sheet 30 is interposed between the bar 21 and the convex surface 6, when the bar 21 is pressed against the processing surface 4, the bar 21 is elastically deformed by the deformation of the elastic sheet 30, whereby the radius of curvature of the upper surface 24 of the bar 21 in the longitudinal direction thereof is made equal to the radius of curvature of the processing surface 4. Accordingly, the upper surface 24 of the bar 21 is uniformly lapped in the longitudinal direction thereof as well as can be made to the crown having the same radius of curvature as that of the processing surface 4 in the short direction of the bar 21.

In the above crown forming apparatus 1, since the relationship between the radius of curvature $R_2$ of the processing surface 4 and the radius of curvature $R_1$ of the convex surface is made to $R_1>R_2$, both the ends of the bar 21 are pressed by the convex surface 6, whereby the entire upper surface (surface to be processed) 24 of the bar 21 can be pressed against the processing surface 4 with uniform force.

When the bar 21 is pressed against the processing surface 4, since both the ends of the bar 21 are pressed against the processing surface 4 at all times, the bar 21 can be lapped in the state where it is deformed to the arc-shape as well as the convex shape is formed to the upper surface 24 of the bar 21 in the short direction thereof by the transfer of the shape of the processing surface 4 thereto, whereby crowns excellent in a dimensional accuracy of shape can be formed.

Since the crown forming apparatus 1 is provided with the drive means 10 for rotating the lapping surface plate 2 as well as swinging the jig 3 in the direction perpendicular to the rotating direction of the lapping surface plate 2, the apparatus 1 can effectively execute lapping.

Further, in the above crown forming apparatus 1, since the bar 21 and the dummy bar 22 are mounted on the jig 3 in parallel with each other in the longitudinal directions thereof, the bar is stably in contact with the processing surface 4 in the short direction thereof without being swung in the short direction of the bar 21, whereby crowns excellent in a dimensional accuracy of shape can be formed.

Next, a third example will be described in detail.

FIG. 1 is shows a crown forming apparatus 1 according to the present invention. The crown forming apparatus 1 mainly comprises a lapping surface plate 2 disposed on a table T, a jig 3 disposed on the lapping surface plate 2, a drive means 10, a control console S standing behind the lapping surface plate 2, a swing plate 11 supported by the control console S, a polishing fluid ejecting nozzle 16 and a correction ring 15.

As shown FIG. 2A and FIG. 2B, the shape of the lapping surface plate 2 is formed to an approximately disc shape and the upper surface thereof is arranged as a concave processing surface 4. The processing surface 4 is tilted downward toward the center of the lapping surface plate 2.

As shown in FIG. 3, the jig 3 is formed to a columnar shape and the upper surface thereof is arranged as a convex surface 6.

Figure 11A:
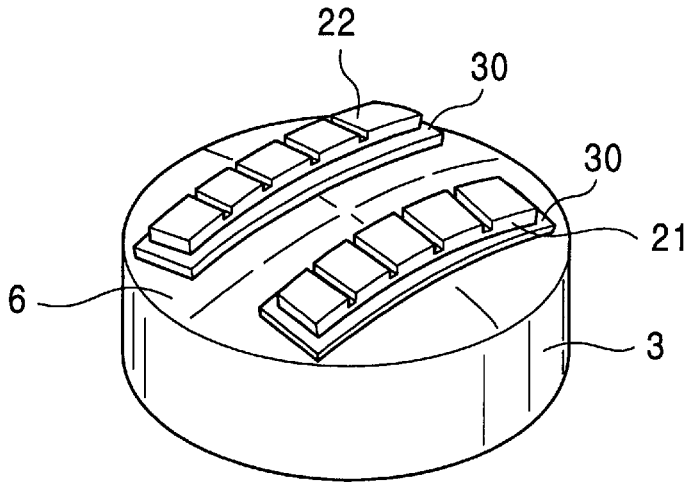
FIG. 11A is a perspective view of the jig.
Figure 11B:
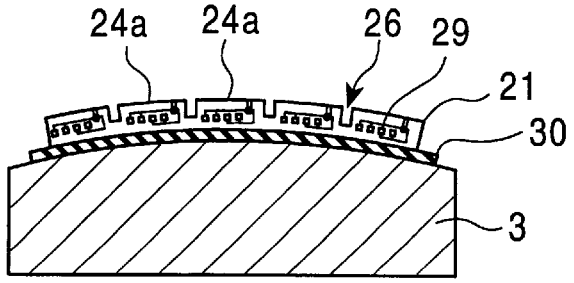
FIG. 11B is a side elevational view in section thereof and FIG. 11C is a front elevational view in section thereof.
Figure 11C:
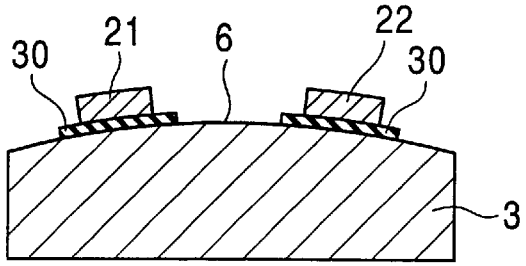

Further, as shown in FIG. 11A–FIG. 11C, a bar 21 is a mounted on the convex surface 6.

The bar 21 is made in such a manner that after a multiplicity of magnetic head elements are formed on a surface of a wafer composed of a material of the slider of a floating type magnetic head using a thin film forming technology or the like, a portion of the wafer is cut to a rectangular-prism-shape.

Figure 10A:
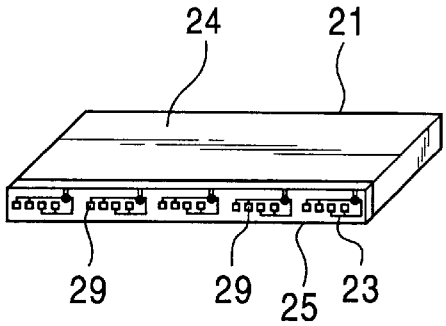
FIG. 10 is a view showing a process for mounting the bar on the jig of the crown forming apparatus as the embodiment of the present invention.

As shown in FIG. 10A, the bar 21 is cut from a wafer so that 5 pieces of magnetic head elements 29 . . . are disposed on the side wall 23 thereof in a row.

Figure 10B:
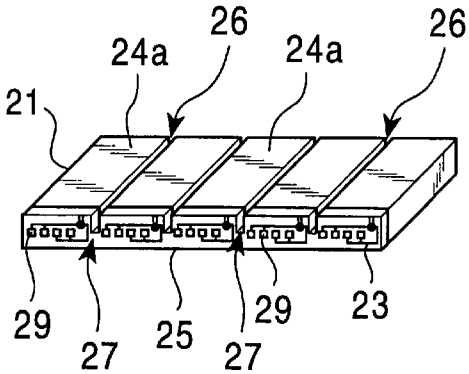

As shown in FIG. 10B, groves 26 . . . are formed on the upper surface (surface to be processed) 24 of the bar 21 adjacent the side wall 23. The groves 26 . . . are formed so as to locate between the respective magnetic head elements 29 . . . .

The thickness of the bar 21 at the portion thereof where the groves 26 are formed is made smaller than the thickness of the other portion thereof by the depth of the groves 26. This portion is referred as a thin wall portion 27.

Further, the upper surface 24 of the bar 21 is divided by the groves 26 . . . so that five divided surfaces 24*a* . . . are formed. The divided surfaces 24*a* . . . serve as the floating surface of a finally obtained floating type magnetic head.

The groves 26 are formed by cutting the upper surface 24 of the bar 21 with, for example, a grindstone or the like.

Note that while the number of the magnetic head elements 29 . . . disposed to the bar 21 is five in FIG. 10, the number is not limited thereto.

While one groove 26 is formed between two magnetic head elements 29 and 29 in FIG. 10B, the number of the grooves is not limited thereto and a plurality of grooves may be disposed between the magnetic head elements 29 and 29.

Figure 10C:
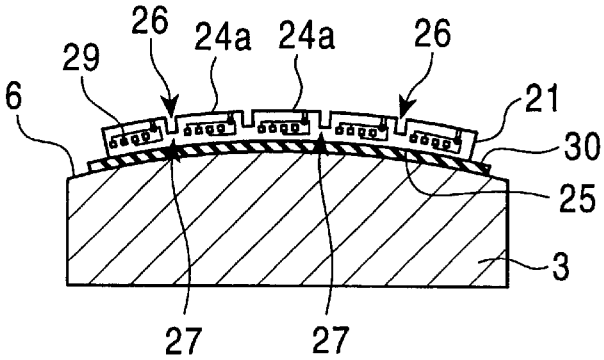

As shown in FIG. 10C, the bar 21 is mounted on the jig 3 in the state where it is deformed to an arc shape in the longitudinal direction of the bar 21 with the divided surfaces 24*a* . . . facing upward and the other surface, which is confronted with the divided surfaces 24*a* . . . , facing downward. It is preferable to preheat the bar 21 to deform it.

As shown in FIG. 11A, a dummy bar 22, which has the same shape as that of the bar 21 and is composed of the same material as that of the bar 21, is attached to the convex surface 6 of the jig 3 spaced apart from the bar 21 in parallel with the longitudinal direction thereof. A plurality of grooves are formed to the dummy bar 22 similarly to the bar 21.

Elastic sheets 30 may be interposed between the bar 21 and the dummy bar 22 and the convex surface 6. Since each elastic sheet 30 is composed of, for example, urethane and has an adhesive surface, the bar 21 can be fixed to the convex surface 6 thereby.

Further, the elastic sheets 30 may be omitted. At the time, the bar 21 and the dummy bar 22 are fixed to the convex surface 6 through an adhesive, wax or the like.

The relationship between the radius of curvature $R_2$ of the processing surface 4 of the lapping surface plate 2 and the radius of curvature $R_1$ of the convex surface 6 of the jig 3 is made to $R_1 \geqq R_2$.

As shown in FIG. 1, the drive means 10 comprises a rotation mechanism 17 for rotating the lapping surface plate 2 and a swing mechanism 18 for pressing the jig 3 against the processing surface 4 of the lapping surface plate 2 and swinging the jig 3 in a direction perpendicular to the rotating direction of the lapping surface plate 2.

Any mechanism may be used as the rotation mechanism 17 so long as it can rotate the lapping surface plate 2. For example, the rotation mechanism 17 may be a motor 7 coupled with the lapping surface plate 2 at the center thereof and rotates the lapping surface plate 2 in the direction of an arrow A as shown in FIG. 1.

The swing mechanism 18 comprises the swing plate 11 disposed on the front surface side of the control console S, a convex unit 12 disposed on the front surface side of the swing plate 11 at an upper portion thereof, a pair of right and left load bars 13 and 13 projecting downward from the convex unit 12, and a load block 14 suspended from the load bars 13 and 13.

A support surface 19 is disposed to the back surface side of the swing plate 11 as shown in FIG. 1, and rail members 118 and 118 shown in FIG. 18 are attached to the support surface 19 on the front surface thereof on the lapping surface plate 2 side, and rail receiving units 119 and 119 are disposed so as to be engaged with the rail members 118 and 118. The rail receiving units 119 and 119 are connected to the back surface of the swing plate 11 so that the swing plate 11 can reciprocate right and left along the rail members 118 and 118.

As shown in FIG. 18, a motor 120 and a link arm 123 are disposed on the front surface side of the support surface 19 between the swing plate 11 and the support surface 19. An end of the link arm 123 is rotatably coupled with an end of an arm plate 122 mounted on the rotatable shaft 121 of the motor 120 through a pin 125 and the other end of the link arm 123 is rotatably coupled with a drive plate 126 at the center thereof through a pin 127 as well as the rail receiving units 119 and 119 are mounted on the drive plate 126 on the upper and lower sides thereof, respectively.

With the above arrangement, the arm plate 122 is rotated by the rotation of the motor 120, whereby the link arm 123 is eccentically rotated at an end thereof as well as the other end of the link arm 123 is reciprocated right and left along the rail members 118 and 118. As a result, the swing plate 11 can swing in the direction of an arrow X in FIG. 1.

As shown in FIG. 1, the jig 3 is mounted on a load block 14 so that the convex surface 6 is confronted with the processing surface 4 of the lapping surface plate 2 and urged toward the lapping surface plate 2 by elastic members (not shown) build into the load bars 13 and 13. With this arrangement, the bar 21 and the dummy bar 22 are pressed against the processing surface 4.

Figure 12:
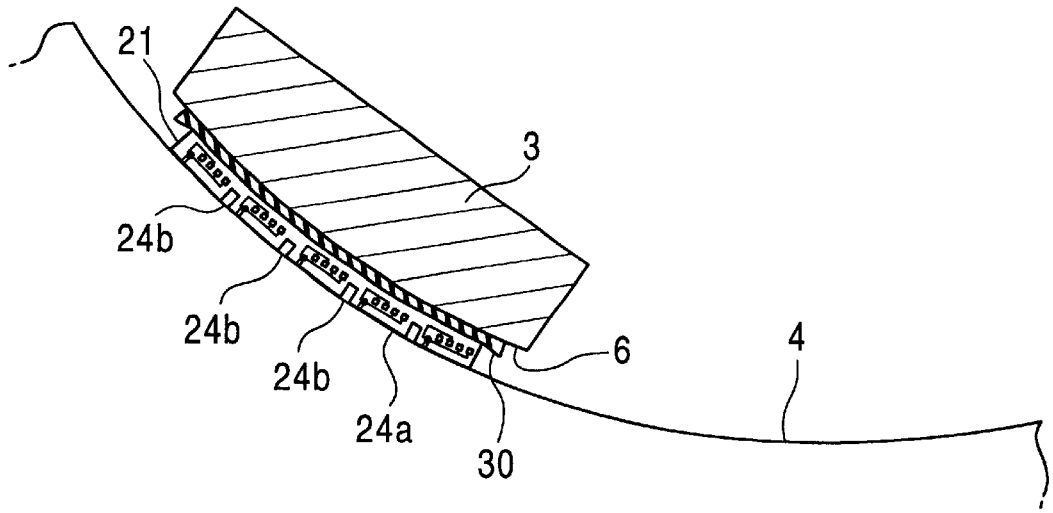
FIG. 12 is a side elevational view in section showing the main portion of the crown forming apparatus as the embodiment of the present invention.
Figure 13:
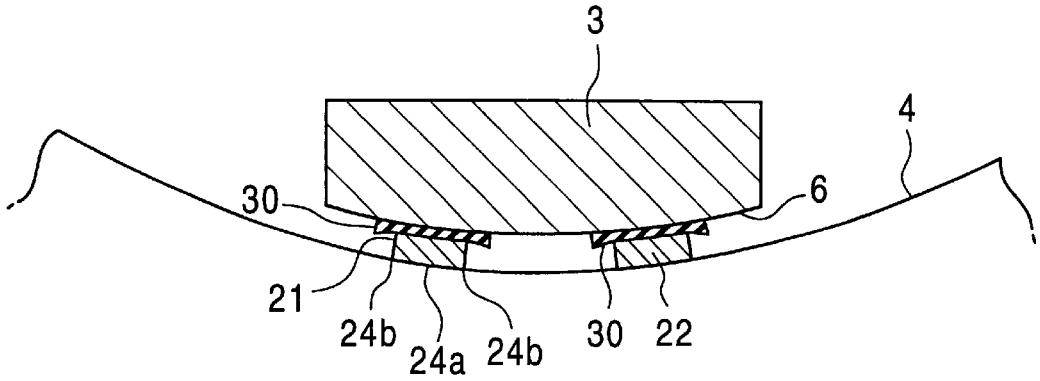
FIG. 13 is a front elevational view in section showing the main portion of the crown forming apparatus as the embodiment of the present invention.

As shown in FIGS. 12 and 13, the jig 3 is disposed on the processing surface 4 so that the divided surfaces 24*a* . . . (upper surface 24) of the bar 21 is abutted against the processing surface 4 of the lapping surface plate 2.

Further, it is preferable that the bar 21 and the dummy bar 22 are mounted on the jig 3 such that the longitudinal directions thereof are in agreement with the swinging direction of the jig 3.

As shown in FIG. 1, the polishing fluid ejecting nozzle 16 ejects a polishing fluid toward the processing surface 4 of the lapping surface plate 2.

The following operation will be executed to form a crown on the divided surfaces 24*a* . . . (upper surface 24) of the bar 21 using the above crown forming apparatus 1.

First, the polishing fluid is sprayed onto the processing surface 4 from the polishing fluid ejecting nozzle 16.

Next, the lapping surface plate 2 is rotated, the bar 21 and the dummy bar 22, which are mounted on the jig 3, are swung in the direction perpendicular to the rotating direction of the lapping surface plate 2 while being abutted again the processing surface 4 by the swing mechanism 18. As a result, the bar 21 and the dummy bar 22 are moved relative to the processing surface 4, and the divided surfaces 24*a* . . . (upper surface 24) of the bar 21 and the upper surface of the dummy bar 22 are caused to slide on the processing surface 4, whereby the divided surfaces 24*a* . . . of the bar 21 is lapped.

At the time, the dummy bar 22 is also lapped by the processing surface 4 similarly to the bar 21.

The main portion of the crown forming apparatus 1 is shown in FIGS. 11, 12 and 13.

As shown in FIGS. 11A and 11B, when the bar 21 is mounted on the jig 3, it can be easily deformed to an arc-shape along the longitudinal direction thereof. However, since the thin wall portions 27 . . . of the bar 21 have low rigidity, the bar 21 is mainly deformed at the thin wall portions 27 . . . Therefore, the divided surfaces 24*a* . . . of the bar 21 are made approximately flat along the longitudinal direction thereof.

Further, the approximate radius of curvature of the entire divided surfaces 24*a* . . . of the bar 21 is made larger than that of the convex surface 6 by the thickness of the bar 21.

The divided surfaces 24*a* . . . of the bar 21 are made approximate flat in the short direction of the bar 21 because the bar 21 is rigid in the short direction and it is difficult for the bar 21 to be flexed in that direction even if it is mounted on the convex surface 6 as shown in FIGS. 11C and 13.

With this processing, the respective divided surfaces 24*a* . . . of the bar 21 mounted on the convex surface 6 are made approximately flat.

When the bar 21 is pressed against the processing surface 4, both the ends of the bar 21 in the longitudinal direction thereof are pressed against the processing surface 4 and the elastic sheet 30 is deformed as shown in FIGS. 6 and 7 because the radius of curvature of the convex surface 6 is equal to or larger than the radius of curvature of the processing surface 4. As a result, the approximate radius of curvature of the entire divided surfaces 24*a* . . . of the bar 21 is made approximately equal to the radius of curvature of the processing surface 4, whereby the corners 24*b* . . . of the respective divided surfaces 24*a* . . . are caused to come into contact with the processing surface 4.

Further, when the bar 21 is directly mounted on the convex surface 6 by means of an adhesive, wax or the like without using the elastic sheets 30, both the ends of the bar 21 in the longitudinal direction thereof are pressed against the processing surface 4, whereby the bar 21 is elastically deformed along the convex surface 6 of the jig 3 so that the approximate radius of curvature of the entire divided surfaces 24*a* . . . is made approximately equal to the radius of curvature of the processing surface 4.

Figure 14A:
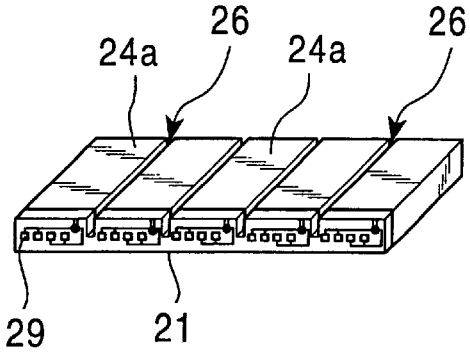
FIG. 14 is a view explaining a process in which the bar is subjected to lapping to obtain a floating type magnetic head.
Figure 14B:
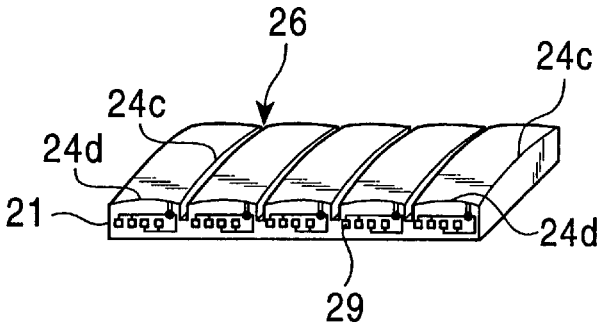

Since the respective divided surfaces 24*a* . . . of the bar 21 come into contact with the processing surface 4 in the flat state, they are lapped by being polished with the processing surface 4 and formed to convex surfaces which are convex in the longitudinal direction and the short direction of the bar 21 as shown in FIG. 14B. With this processing, crowns 24*c* and cross crowns 24*d* are simultaneously formed.

Figure 14C:
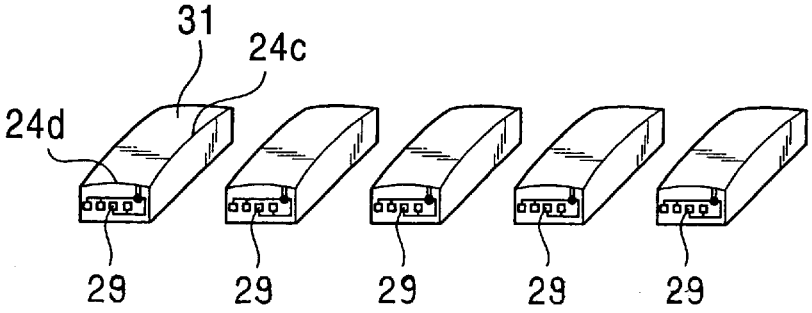

The bar 21, whose divided surfaces 24*a* . . . are formed to the convex surfaces in the above processing, is removed from jig 3 and the elastic sheet 30 and cut in the longitudinal direction at equal intervals so that floating type magnetic heads 28 are obtained (FIG. 14C). The floating surface 31 of the floating type magnetic head 29 is originally the divided surface 24*a* of the bar 21 and the crown 24*c* and the cross crown 24*d* are formed on the floating surface 31.

In the above method of forming the crown of a floating type magnetic head, the bar 21 having the plurality of magnetic head elements disposed thereto in a row is mounted on the convex surface 6 of the jig 3 and lapped by being pressed against the concave processing surface 4. Accordingly, the floating surfaces of a plurality of floating type magnetic heads can be simultaneously lapped, whereby the productivity of the floating type magnetic head can be enhanced.

The plurality of groves 26 are formed between the magnetic head elements 29 . . . on the upper surface (surface to be processed) 24 of the bar 21 so as to arrange the upper surface 24 as the plurality of divided surfaces 24*a* . . . . Then, the bar 21 is deformed to the arc shape along the longitudinal direction thereof and mounted on the convex surface 6 of the jig 3 and the respective divided surfaces 24*a* . . . are lapped. Thus, the crowns 24*c* and the cross crowns 24*d* can be simultaneously formed.

In the above method of forming the crown of a floating type magnetic head, the lapping surface plate 2 is rotated as well as the jig 3 is swung in the direction perpendicular to the rotating direction of the lapping surface plate 2 to thereby move the bar 21 relative to the processing surface 4. Accordingly, the bar 21 can be effectively lapped.

Since the bar 21 is swung in the direction perpendicular to the rotating direction of the lapping surface plate 2, no scratches remain on the upper surface (surface to be processed) 24 of the bar 21 along the rotating direction of the lapping surface plate 2.

Since the bar 21 is lapped while being in uniform contact with the entire surface of the processing surface 4 by swinging the jig 3 in the direction perpendicular to the rotating direction of the lapping surface plate 2, the processing surface 4 is not partly worn eccentrically, whereby the entire surface of the processing surface 4 can be uniformly worn and the deformation thereof can be prevented.

Further, in the above method of forming the crown of a floating type magnetic head, the bar 21 and the dummy bar 22 are mounted on the jig 3 in parallel with each other in the longitudinal directions thereof and they are pressed against the processing surface 4 at all times. Accordingly, the bar 21 can be lapped while being stably in contact with the processing surface 4 in the short direction thereof, whereby crowns excellent in a dimensional accuracy of shape can be formed.

Since the above crown forming apparatus 1 comprises the jig 3, on which the bar 21 having the plurality of magnetic head elements disposed thereto in a row is mounted, the lapping surface plate 2 having the processing surface 4 formed to the concave shape and the drive means 10, it can lap the floating surfaces of a plurality of floating type magnetic heads at the same time.

Since the jig 3 has the convex surface 6, the bar 21, which has the plurality of grooves 26 formed on the upper surface 24 thereof and whose upper surface 24 is arranged as the plurality of divided surfaces 24*a* . . . , can be fixed in the state where it is deformed to the arc shape in the longitudinal direction thereof. Further, since the respective divided surfaces 24*a* . . . are reliably abutted against the processing surface 4, the crowns 24*c* and the cross crowns 24*d* each having the same shape can be formed on the respective divided surfaces 24*a* . . . .

Further, in the above crown forming apparatus 1, when the bar 21 is pressed against the processing surface 4, the bar 21 is elastically deformed by the deformation of the elastic sheet 30, the wax or the like so that the approximate radius of curvature of the entire divided surfaces 24*a* . . . of the bar 21 in the longitudinal direction thereof can be made equal to the radius of curvature of the processing surface 4. As a result, the respective divided surfaces 24*a* . . . are reliably abutted against the processing surface 4, whereby the crowns 24*c* of the same shape and the cross crowns 24*d* of the same shape can be formed on the respective divided surfaces 24*a* . . . .

Since the shape of the processing surface 4 is transferred onto the divided surfaces 24*a* . . . , the crowns 24*c* and the cross crowns 24*d* which are excellent in a dimensional accuracy of shape can be obtained.

Since the above crown forming apparatus 1 is provided with the drive means 10 for rotating the lapping surface plate 2 and swinging the jig 3 in the direction perpendicular to the rotating direction of the lapping surface plate 2 while pressing the jig 3 against the processing surface 4, the apparatus 1 can effectively execute a lapping operation.

Since the bar 21 is swung in the direction perpendicular to the rotating direction of the lapping surface plate 2, no scratches remain on the upper surface (surface to be processed) 24 of the bar 21 along the rotating direction of the lapping surface plate 2.

Since the bar 21 is lapped while being in uniform contact with the entire surface of the processing surface 4 by swinging the jig 3 in the direction perpendicular to the rotating direction of the lapping surface plate 2, the processing surface 4 is not partly worn eccentrically, whereby the entire surface of the processing surface 4 can be uniformly worn and the deformation thereof can be prevented.

Further, in the above crown forming apparatus 1, since the bar 21 and the dummy bar 22 are mounted on the jig 3 in parallel with each other in the longitudinal directions thereof, the bar is stably in contact with the processing surface 4 in the short direction thereof without being swung in the short direction of the bar 21, whereby the crowns 24*c* and the cross crowns 24*d* excellent in a dimensional accuracy of shape can be formed.

Further, in the above crown forming apparatus 1, when the radius of curvature of the processing surface 4 is represented by $R_2$ and the radius of curvature of the convex surface 6 is represented by $R_1$, the relationship therebetween is shown by $R_1 \geqq R_2$. When the bar 21 is pressed against the processing surface 4, both the ends of the bar 21 are pressed against the processing surface 4 at all times as well as the respective divided surfaces 24*a* . . . of the bar 21 are reliably pressed against the processing surface 4. Accordingly, the bar 21 can be lapped while it is deformed to the arc shape at all times. In addition, since the shape of the processing surface 4 is transferred onto the divided surfaces 24*a* . . . of the bar 21, the crowns 24*c* and the cross crowns 24*d* excellent in a dimensional accuracy of shape can be formed.

Embodiment

Experimental Example 1

The effect of the crown heights of a bar on the relationship between the radius of curvature $R_2$ of the processing surface of a lapping surface plate and the radius of curvature $R_1$ of the convex surface of a jig was examined.

First, a wafer composed $Al_2O_3$—TiC ceramics was cut to approximately rectangular-prism-shaped bars.

Further, dummy bars having the same shape as the above bars and composed of $Al_2O_3$—TiC ceramics were prepared.

Next, a jig having a convex surface was prepared and elastic sheets composed of urethane having a width of 1 mm were bonded to the convex surface. Further, a bar and a dummy bar were deformed to an arc shape and bonded to the elastic sheets on the convex surface. The bar and the dummy bar were bonded to the jig in such a manner that they were spaced apart from each other in parallel with each other in the longitudinal directions thereof.

Jigs whose convex surfaces had radius of curvatures ($R_1$) of 10.0 m and 12.0 m were used as the above jig.

Further, a lapping surface plate having a concave processing surface was prepared. The radius of curvature ($R_2$) of the processing surface was 10.0 m.

Next, the jig and the lapping surface plate were mounted on the crown forming apparatus shown in FIG. 1 and crowns were formed on the surface to be processed of the bar by executing lapping by rotating the lapping surface plate while swinging the jig.

Next, the bar and the dummy bar which had been lapped were removed, and a new bar and a new dummy bar were mounted on the jig and lapped by operating the jig and the lapping surface plate again. A multiplicity of bars on which crowns were formed were obtained by repeating the above operation. The crown heights of the thus obtained bars were measured.

The effect of the crown heights on the relationship between $R_1$ and $R_2$ was examined as described above. FIGS. 20 and 21 shows the result of examination.

Figure 20A:
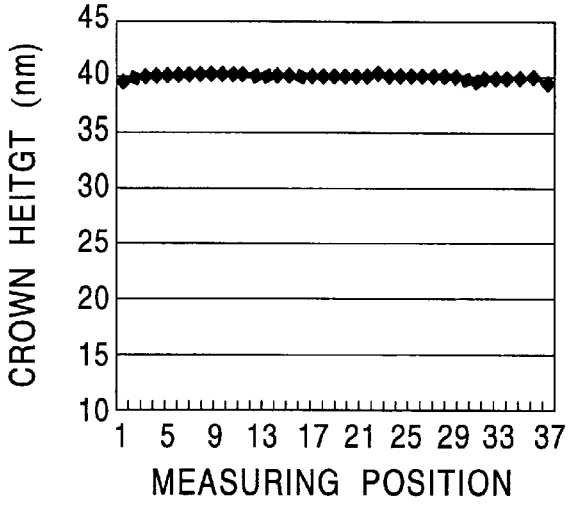
FIG. 20A is view showing the height of the crown of a 80th bar.
Figure 20B:
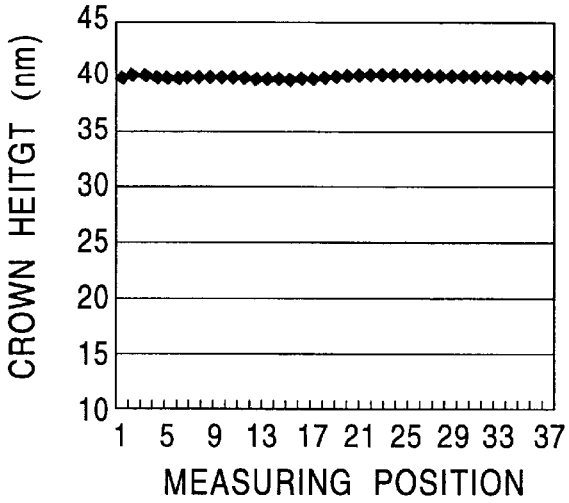
FIG. 20B is a view showing the height of the crown of a 85th bar.
Figure 20C:
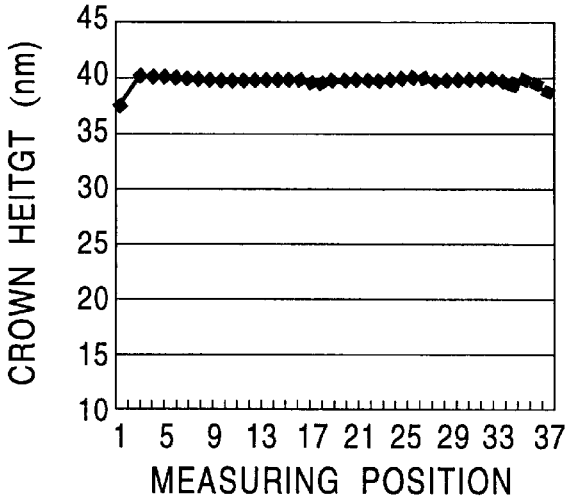
FIG. 20C is a view showing the height of the crown of a 90th bar.

FIG. 20A–FIG. 20C show the distributions of crown heights with respect to the longitudinal direction of bars when $R_1$ is 12.0 mm and $R_2$ is 10.0 m, respectively.

Figure 21A:
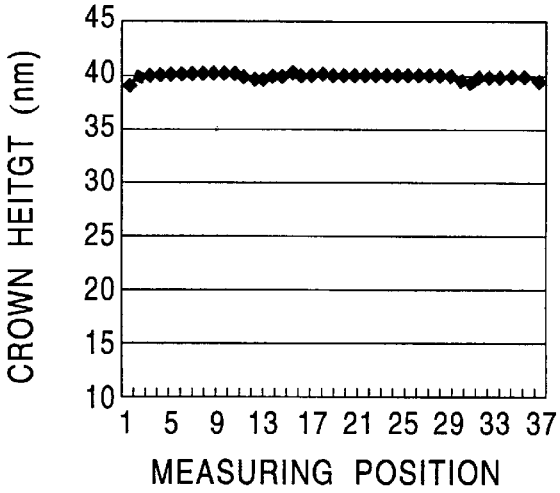
FIG. 21A is view showing the height of the crown of a 80th bar.
Figure 21B:
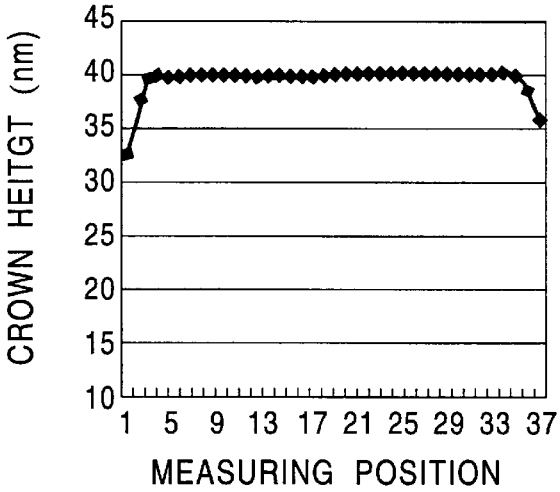
FIG. 21B is a view showing the height of the crown of a 85th bar.
Figure 21C:
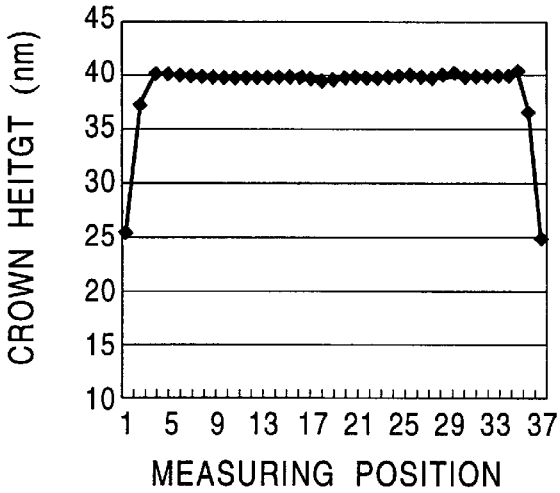
FIG. 21C is a view showing the height of the crown of a 90th bar.

Further, FIGS. 21A–21C show the distributions of crown heights with respect to the longitudinal direction of bars when both $R_1$ and $R_2$ are 10.0 m, respectively.

The crown heights were measured at measuring positions disposed at 37 points of the bars at equal intervals in the longitudinal direction thereof. The abscissas of FIG. 20A–20C and FIG. 21A–21C show these measuring positions.

FIGS. 20A and 21A show the distributions of the crown heights of a 80th bar, FIGS. 20B and 21B show the distributions of the crown heights of a 85th bar, and FIGS. 20C and 21C show the distributions of the crown heights of a 90th bar, respectively.

Further, the results shown in FIGS. 20A–21C were statistically processed and the average values and the standard deviations of the crown heights of the respective bars were determined. Table 1 shows the average values and Table 2 shows the standard deviations.

As apparent from FIGS. 20A–20C, when $R_1>R_2$, the reduction of the crown heights of the bars at both the ends thereof was admitted for the first time when the 90th bar was lapped.

In contrast, as apparent from FIGS. 21A–21C, when $R_1=R_2$, the reduction of the crown heights of the bars at both the ends thereof was admitted when the 85th bar was lapped.

Further, as shown in Table 2, when $R_1=R_2$, the standard deviation of the crown heights was made to 1.43 when the 85th bar was lapped. This standard deviation is larger than the standard deviation (0.58) of the bar when $R_1>R_2$, which results from the effect of the reduction of the crown heights at both the ends of the bar.

Therefore, according to the crown forming method and the crown forming apparatus of the present invention for forming a crown on a floating type magnetic head, it is apparent that the shapes of the crowns of a bar in the longitudinal direction thereof can be made uniform.

TABLE 1

| | $R_1 > R_2$ | $R_1 = R_2$ |
|---|---|---|
| 80th bar | 40.1 | 40.1 |
| 85th bar | 40.1 | 39.7 |
| 90th bar | 39.9 | 39.1 |

TABLE 2

| | $R_1 > R_2$ | $R_1 = R_2$ |
|---|---|---|
| 80th bar | 0.29 | 0.34 |
| 85th bar | 0.17 | 1.43 |
| 90th bar | 0.58 | 3.31 |

Experimental Example 2

The relationship between the depths of grooves formed on a bar and the crown heights and the cross crown heights of the bar after it was lapped was examined.

First, a multiplicity of magnetic head elements were formed on a wafer composed of $Al_2O_3$—TiC ceramics using a thin film forming technology. Next, the wafer was cut to approximately rectangular-prism-shaped bars. At the time, the wafer was cut such that a plurality of magnetic head elements were disposed in a row on a side wall of each bar.

Further, a plurality of grooves were formed at positions between the respective magnetic head elements on a surface of the bar.

Bars, on which grooves having a width of 125 $\mu$m and a depth varying from 0–0.15 $\mu$m were formed, were prepared.

Further, dummy bars having the same shape as the above bars and composed of $Al_2O_3$—TiC ceramics were prepared.

Next, a jig having a convex surface was prepared and elastic sheets composed of urethane having a width of 1 mm were bonded to the convex surface. Further, a bar and a dummy bar were deformed to an arc shape and bonded to the elastic sheets on the convex surface. The bar and the dummy bar were bonded to the jig in such a manner that they were spaced apart from each other in parallel with each other in the longitudinal directions thereof.

Further, a lapping surface plate having a concave processing surface was prepared.

Next, the jig and the lapping surface plate were mounted on the crown forming apparatus shown in FIG. 1 and crowns and cross crowns were formed on the divided surfaces of the bar by executing lapping by rotating the lapping surface plate while swinging the jig.

The crown heights and the cross crown heights on the respective divided surfaces of the thus obtained bar were measured and the average values of the respective characteristic values were obtained. FIG. 22 shows the result of measurements.

Figure 22A:
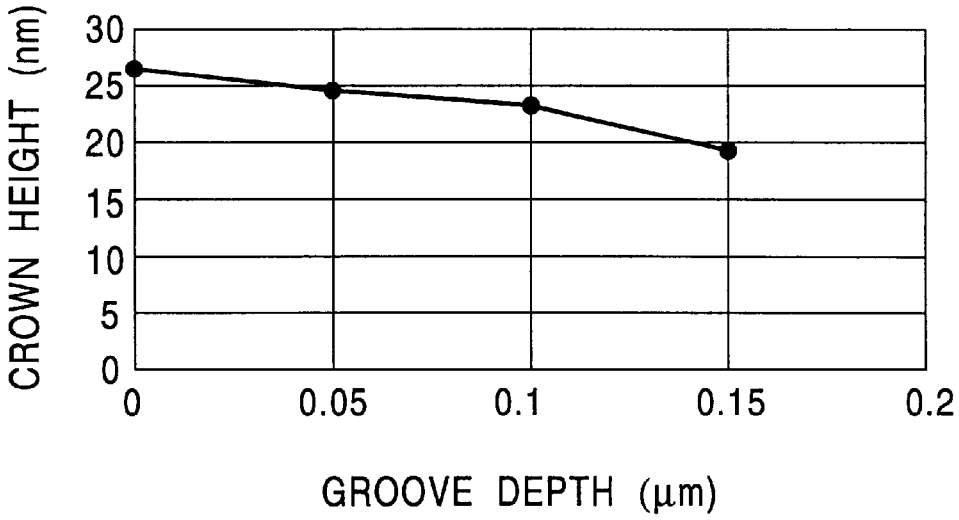
FIG. 22A is a view showing the height of a groove and the height of a crown and FIG. 22B is a view showing the height of a groove and the height of a cross crown.

As shown in FIG. 22A, when the groove depth was increased from 0 μm to 0.15 μm, the crown height was decreased from 27 nm to 19 nm.

Figure 22B:
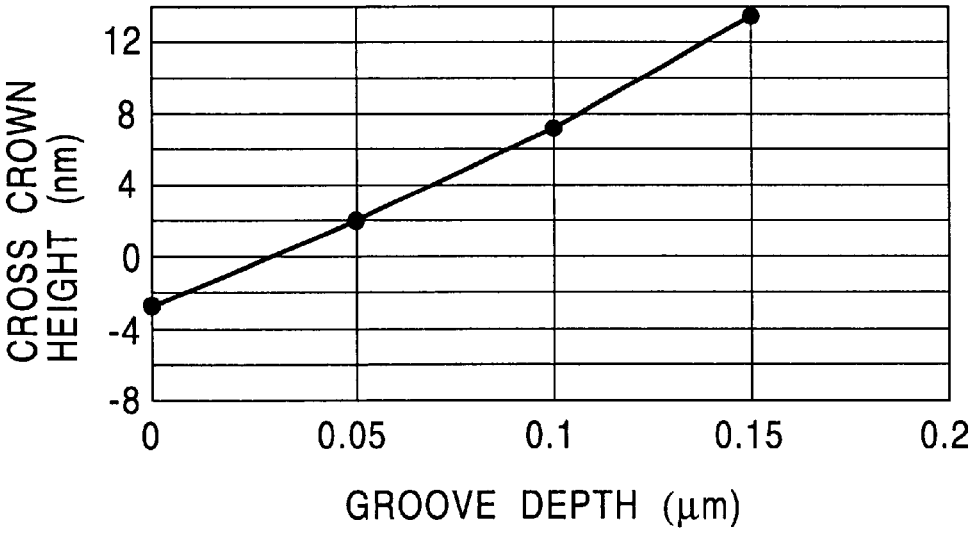

Further, as shown in FIG. 22B, when the groove depth was increased from 0 μm to 0.15 μm, the cross crown height was linearly increased from −2.7 nm to 13 nm.

As described above, it was found that the crown height and the cross crown height could be particularly adjusted by changing the groove depth.

While the reason why the groove depth affected the values of the crown height and the cross crown height is not apparent, it is assumed that this is caused by that the rigidity of the bar in the longitudinal direction thereof is changed depending upon the groove depth.

Experimental Example 3

The relationship between the widths of grooves formed on a bar and the crown heights and the cross crown heights of the bar after it was lapped was examined.

Bars were made similarly to the bars used in the experimental example 1 except that the grooves of each bar had a depth of about 75 μm and a width varying from 125 μm to 190 μm.

The crown heights and the cross crown heights on the respective divided surfaces of the thus obtained bars were measured. FIG. 23 shows the result of measurement.

Figure 23A:
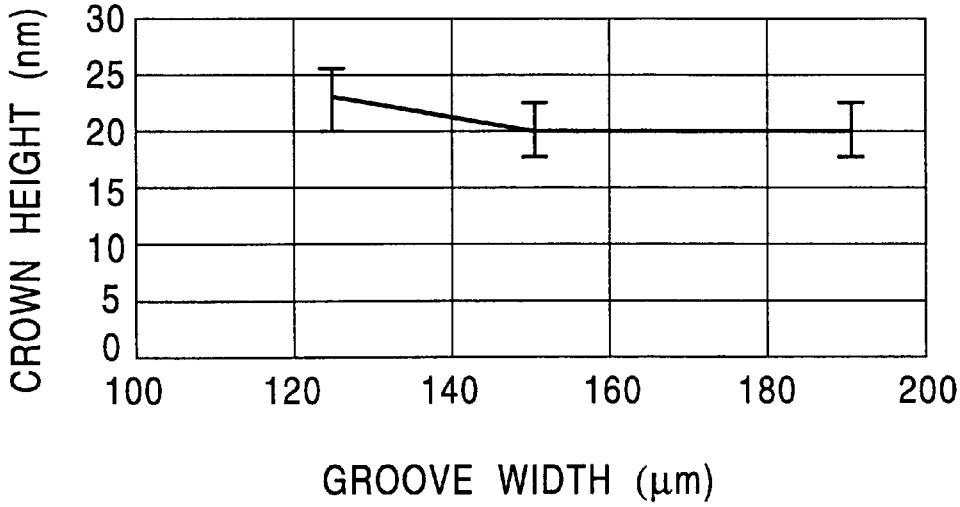
FIG. 23A is a view showing the width of a groove and the height of a crown and FIG. 23B is a view showing the width of a groove and the height of a cross crown.

As shown in FIG. 23A, when the groove width was increased from 125 μm to 190 μm, there was a tendency that the crown height was somewhat reduced from 23 nm to 20 nm in average. The variation of the crown heights was not greatly changed in the width of each groove.

Figure 23B:
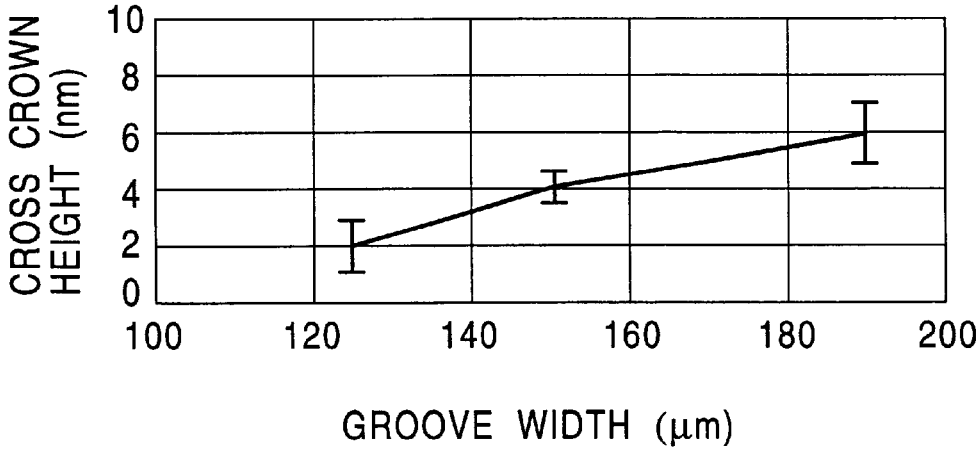

Further, as shown in FIG. 23B, when the groove width was increased from 125 μm to 190 μm, the cross crown height was linearly increased from 2 nm to 6 nm. There was exhibited a tendency that the variation of the crown heights was increased in the width of each groove with an increase in the width of the grooves.

It was found that when the groove width was changed, the cross crown height was linearly increased while the crown height was not greatly changed.

While the reason why the groove width affected the values of the cross crown height is not apparent, it is assumed that this is caused by the change of rigidity of the bar in the longitudinal direction thereof similarly to the experimental example 1.

Experimental Example 4

The relationship between the roughness of the bottom surfaces of grooves formed on a bar and the crown heights and the cross crown heights of the bar after it was lapped was examined.

Bars were made similarly to the bars used in the experimental example 1 except that the bars were cut with grindstones of 600–2000 meshes and grooves having a depth of about 75 μm and a width of about 125 μm were formed thereon.

The crown heights and the cross crown heights of the thus obtained bars on the respective divided surfaces thereof were measured. FIG. 24 shows the result of measurement.

Figure 24A:
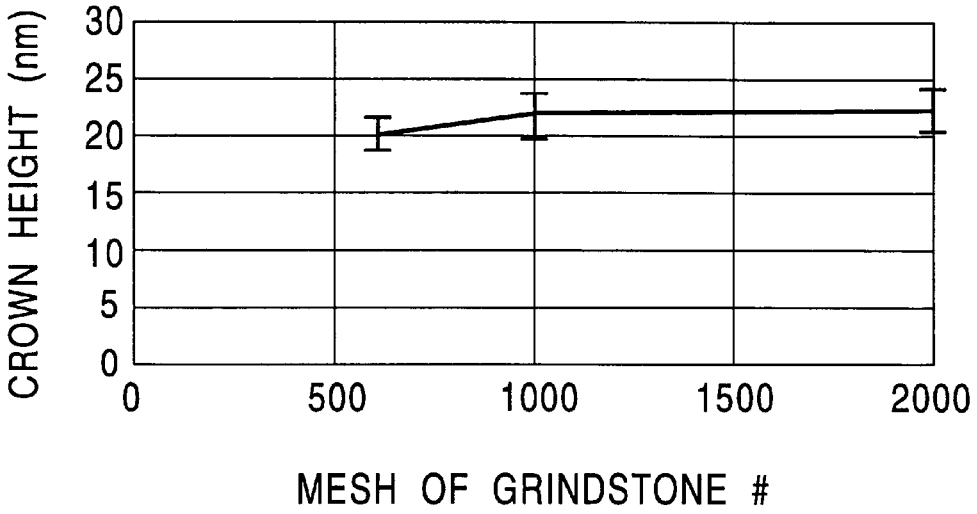
FIG. 24A PRIOR ART
FIG. 24A is a view showing the roughness of a grindstone and the height of a crown and FIG. 24B is a view showing the roughness of a grindstone and the height of a cross crown.

As shown in FIG. 24A, there was a tendency that the crown heights were somewhat increased from 20 nm to 23 nm in average when the roughness of the grindstones was increased from 600 meshes to 2000 meshes. The variation of the crown heights in each roughness of the grindstone was not greatly changed.

Figure 24B:
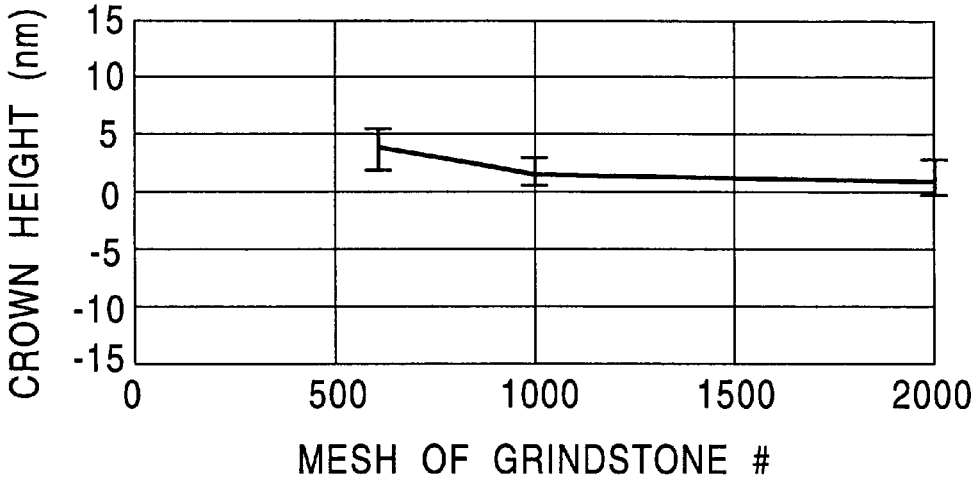
FIG. 24B PRIOR ART

Further, as shown in FIG. 24B, when the roughness of the grindstones was increased from 600 meshes to 2000 meshes, the cross crown heights were linearly decreased from 3 nm to 1 nm. The variation of the cross crown heights in each roughness of the grindstones was not also greatly changed.

It was found that when the width of the grooves was arbitrarily changed, the cross crown heights were somewhat linearly reduced while the crown heights were not greatly changed.

From the results of the above experimental examples 1–4, it was found that the cross crown heights of the cross crowns formed on the divided surfaces of a bar can be changed by changing the width and depth of grooves and the roughness of the entire surfaces of the grooves without changing the radius of curvatures of the processing surface of the lapping surface plate and the convex surface of the jig.

Further, it was found that the crown heights of the crowns formed on the divided surfaces of a bar could be changed by changing the depth of grooves.

As described above in detail, in the method of forming the crown of a floating type magnetic head according to the first and second examples of the present invention, the bar having the plurality of magnetic head elements disposed thereto in a row is mounted on the convex surface of the jig and lapped by being pressed against the concave processing surface. Accordingly, the floating surfaces of a plurality of floating type magnetic heads can be simultaneously lapped, whereby the productivity of the floating type magnetic head can be enhanced.

Further, in the method of forming the crown of a floating type magnetic head of the present invention, when the bar is pressed against the processing surface, the bar is elastically deformed by the deformation of the elastic sheet so that the radius of curvature of the surface to be processed of the bar in the longitudinal direction thereof is made equal to the radius of curvature of the processing surface. As a result, the bar can be uniformly lapped in the longitudinal direction thereof as well as a convex surface whose radius of curvature is the same as that of the processing surface can be formed on the bar in the short direction thereof.

In the method of forming the crown of a floating type magnetic head of the present invention, since the radius of curvature $R_2$ of the processing surface and the radius of curvature $R_1$ of the convex surface have the relationship $R_1>R_2$, both the ends of the bar in the longitudinal direction thereof are pressed by the convex surface, whereby the surface to be processed of the bar can be entirely pressed against the processing surface with uniform force, and thus the bar can be uniformly lapped the in longitudinal direction thereof.

When the bar is pressed against the processing surface, both the ends of the bar are pressed against the processing surface at all the times so that the bar can be lapped while being always deformed to the arc shape.

Further, since the convex surface of the bar is formed by the transfer of the shape of the processing surface thereto, crowns excellent in a dimensional accuracy of shape can be obtained.

In the method of forming the crown of a floating type magnetic head of the present invention, the lapping surface plate is rotated as well as the jig is swung in the direction perpendicular to the rotating direction of the lapping surface plate to thereby move the bar relative to the processing surface. Accordingly, the bar can be effectively lapped.

Further, in the method of forming the crown of a floating type magnetic head of the present invention, the bar and the dummy bar are mounted on the jig in parallel with each other in the longitudinal directions thereof and they are pressed against the processing surface at all times. Accordingly, the bar can be lapped while being stably in contact with the processing surface in the short direction thereof, whereby crowns excellent in a dimensional accuracy of shape can be formed.

Since the crown forming apparatus of the present invention comprises the jig, on which the bar having the plurality of magnetic head elements disposed thereto in a row is mounted, the lapping surface plate having the processing surface formed to the concave shape and the drive means, it can lap the floating surfaces of a plurality of floating type magnetic heads at the same time.

Since the jig of the crown forming apparatus of the present invention has the convex surface, it can hold the bar 21 while deforming it in the arc shape in the longitudinal direction thereof, whereby the crown, which is convex along the short direction of the bar can be formed on the surface to be processed thereof.

In the crown forming apparatus of the present invention, since the elastic sheet is interposed between the bar 21 and the convex surface, when the bar is pressed against the processing surface, the bar is elastically deformed by the deformation of the elastic sheet, whereby the radius of curvature of the surface to be processed of the bar in the longitudinal direction thereof is made equal to the radius of curvature of the processing surface 4. Accordingly, the surface to be processed of the bar is uniformly lapped in the longitudinal direction thereof as well as can be made to the crown having the same radius of curvature as that of the processing surface in the short direction of the bar.

In the crown forming apparatus of the present invention, since the relationship between the radius of curvature $R_2$ of the processing surface and the radius of curvature $R_1$ of the convex surface is made to $R_1>R_2$, both the ends of the bar are pressed by the convex surface, whereby the entire surface to be processed of the bar can be pressed against the processing surface with uniform force.

When the bar is pressed against the processing surface, since both the ends of the bar are pressed against the processing surface at all times, the bar can be lapped in the state where it is deformed to the arc-shape as well as the convex shape is formed to the surface to be processed of the bar in the short direction thereof by the transfer of the shape of the processing surface thereto, whereby crowns excellent in a dimensional accuracy of shape can be formed.

In the crown forming apparatus of the present invention, since the drive means rotates the lapping surface plate as well as swings the jig in the direction perpendicular to the rotating direction of the lapping surface plate, lapping can be effectively carried out.

Further, since the bar is swung in the longitudinal direction thereof, lapping can be uniformly applied to the bar in the longitudinal direction thereof.

Furthermore, in the crown forming apparatus of the present invention, since the bar and the dummy bar are bonded to the jig in parallel with each other in the longitudinal directions thereof, the bar is stably in contact with the processing surface in the short direction thereof without being swung in the short direction of the bar, whereby crowns excellent in a dimensional accuracy of shape can be formed.

As described above in detail, in the method of forming the crown of a floating type magnetic head according to the third example of the present invention, the bar having the plurality of magnetic head elements disposed thereto in a row is mounted on the convex surface of the jig and lapped by being pressed against the concave processing surface. Accordingly, the floating surfaces of a plurality of floating type magnetic heads can be simultaneously lapped, whereby the productivity of the floating type magnetic head can be enhanced.

The plurality of groves are formed between the magnetic head elements 29 on the surface to be processed of the bar so as to arrange the surface to be processed as the plurality of divided surfaces. Then, the bar is deformed to the arc shape along the longitudinal direction thereof and mounted on the jig having the convex surface and the respective divided surfaces are lapped. Thus, the crowns and the cross crowns can be simultaneously formed.

When one groove is formed between the magnetic head, a process for forming the groove is simplified and the productivity of the floating type magnetic head can be enhanced.

Further, in the method of forming the crown of a floating type magnetic head of the present invention, the radius of curvatures of the crowns and the cross crowns of the bar can be independently changed by changing the width and the depth of the grooves, the roughness of the entire surfaces of the grooves and the like. Thus, the crowns and cross crowns whose radius of curvatures are different from each other can be formed at the same time.

In the method of forming the crown of a floating type magnetic head of the present invention, the lapping surface plate is rotated as well as the jig is swung in the direction perpendicular to the rotating direction of the lapping surface plate to thereby move the respective divided surfaces of the bar relative to the processing surface. Accordingly, the bar can be effectively lapped.

Since the bar is swung in the direction perpendicular to the rotating direction of the lapping surface plate, no scratches remain on the surface to be processed of the bar along the rotating direction of the lapping surface plate.

Since the bar is lapped while being in uniform contact with the entire surface of the processing surface by swinging the jig in the direction perpendicular to the rotating direction of the lapping surface plate, the processing surface is not partly worn eccentrically, whereby the entire surface of the processing surface can be uniformly worn and the deformation thereof can be prevented.

Further, in the method of forming the crown of a floating type magnetic head of the present invention, the bar and the dummy bar are mounted on the jig in parallel with each other in the longitudinal directions thereof and they are pressed against the processing surface at all times. Accordingly, the bar can be lapped while being stably in contact with the processing surface in the short direction thereof, whereby crowns excellent in a dimensional accuracy of shape can be formed.

Since the crown forming apparatus of the present invention comprises the jig, on which the bar having the plurality of magnetic head elements disposed thereto in a row is mounted, the lapping surface plate having the processing surface formed to the concave shape and the drive means, it can lap the floating surfaces of a plurality of floating type magnetic heads at the same time.

The jig of the crown forming apparatus of the present invention has the convex surface, the jig can fix the bar while deforming it to the arc-shape along the longitudinal direction thereof. Since the respective divided surfaces are reliably abutted against the processing surface thereby, the crowns and the cross crowns can be simultaneously formed on the respective divided surface.

Further, in the crown forming apparatus of the present invention, when the bar is pressed against the processing surface, the bar 21 is elastically deformed along the convex surface of the jig so that the approximate radius of curvature of the entire divided surfaces of the bar in the longitudinal direction thereof can be made equal to the radius of curvature of the processing surface. As a result, the respective divided surfaces are reliably abutted against the processing surface, whereby the crowns and the cross crowns can be formed on the respective divided surfaces at the same time.

Since the shape of the processing surface is transferred onto the divided surfaces, crowns and cross crowns which are excellent in a dimensional accuracy of shape can be obtained.

Since the crown forming apparatus of the present invention is provided with the drive means for rotating the lapping surface plate and swinging the jig in the direction perpendicular to the rotating direction of the lapping surface plate while pressing the jig 3 against the processing surface, the apparatus can effectively execute a lapping operation.

Since the bar is swung in the direction perpendicular to the rotating direction of the lapping surface plate, no scratches remain on the surface to be processed of the bar along the rotating direction of the lapping surface plate.

Since the bar is lapped while being in uniform contact with the entire surface of the processing surface by swinging the jig in the direction perpendicular to the rotating direction of the lapping surface plate, the processing surface is not partly worn eccentrically, whereby the entire surface of the processing surface can be uniformly worn and the deformation thereof can be prevented.

Further, in the crown forming apparatus of the present invention, since the bar and the dummy bar are mounted on the jig in parallel with each other in the longitudinal directions thereof, the bar is stably in contact with the processing surface in the short direction thereof without being swung in the short direction of the bar, whereby crowns and cross crowns excellent in a dimensional accuracy of shape can be formed.

Further, in the crown forming apparatus of the present invention, when the radius of curvature of the processing surface is represented by $R_2$ and the radius of curvature of the convex surface is represented by $R_1$, the relationship therebetween is shown by $R_1 \geqq R_2$. When the bar is pressed against the processing surface, both the ends of the bar are pressed against the processing surface at all times as well as the respective divided surfaces of the bar are reliably pressed against the processing surface. Accordingly, the bar can be lapped while it is deformed to the arc shape at all times. In addition, since the shape of the processing surface is transferred onto the divided surfaces of the bar, crowns and cross crowns excellent in a dimensional accuracy of shape can be formed.

What is claimed is:

1. A crown forming method of forming a crown on a floating type magnetic head by lapping a surface to be processed of an approximately rectangular-prism-shaped bar having a short direction and a longitudinal direction, the bar having a side wall which is adjacent to the surface to be processed, the side wall having magnetic head elements of not less than 1 disposed thereon in a row, and cutting the bar in the short direction thereof to manufacture the floating type magnetic head having a floating surface composed of the surface to be processed and at least one piece of the magnetic head elements, the method comprising the steps of:

placing the bar on a convex surface of a jig whose radius of curvature is $R_1$ through an elastic sheet while facing the surface to be processed of the bar to a lapping surface plate having a concave processing surface whose radius of curvature is $R_2$ with the relationship between the radius of curvatures set to $R_1 \geqq R_2$;

deforming the bar to an arc shape along the longitudinal direction thereof and bonding it on the convex surface together with the elastic sheet; and lapping the surface to be processed of the bar by abutting it against the processing surface of said lapping surface plate and moving the surface to be processed relative to the processing surface, thereby forming the crown on the floating surface of the floating type magnetic head.

2. The crown forming method of forming a crown on a floating type magnetic head according to claim 1, wherein the surface to be processed of the bar is moved relative to the processing surface of said lapping surface plate by rotating said lapping surface plate and swinging the bar in a direction perpendicular to the rotating direction of said lapping surface plate.

3. The crown forming method of forming a crown on a floating type magnetic head according to claim 2, wherein a dummy bar, which has the same shape as that of the bar and is composed of the same material as that of the bar, is bonded to the convex surface of said jig through an elastic sheet spaced apart from the bar in parallel with the longitudinal direction thereof.

4. The crown forming method of forming a crown on a floating type magnetic head according to claim 1, wherein a dummy bar, which has the same shape as that of the bar and is composed of the same material as that of the bar, is bonded to the convex surface of said jig through an elastic sheet spaced apart from the bar in parallel with the relative to the processing surface, thereby forming the crown on the floating surface of the floating type magnetic head.

5. A crown forming method of forming a crown on a floating type magnetic head by lapping a surface to be processed of an approximately rectangular-prism-shaped bar having a short direction and a longitudinal direction, the bar having a side wall which is adjacent to the surface to be processed, the side wall having magnetic head elements of not less than 1 disposed thereon in a row or in a plurality of rows, and cutting the bar in the short direction thereof to manufacture the floating type magnetic head having a floating surface composed of the surface to be processed and at least one piece of the magnetic head elements, the method comprising the steps of:

making the surface to be processed to a plurality of divided surfaces by disposing at least one groove on the surface to be processed of the bar so as to be located between the respective magnetic head elements along the short direction of the bar;

deforming the bar to an arc shape along the longitudinal direction thereof and bonding it on a convex surface of a jig while facing the respective divided surfaces of the bar to a lapping surface plate having a concave processing surface; and lapping the respective divided surfaces of the bar by abutting them against the processing surface of said lapping surface plate and moving the respective divided surfaces relative to the processing surface, thereby forming the crown on the floating surface of the floating type magnetic head.

6. The crown forming method of forming a crown on a floating type magnetic head according to claim 5, wherein the number of the grooves formed between the respective magnetic head elements is 1.

7. The crown forming method of forming a crown on a floating type magnetic head according to claim 6, wherein the respective divided surfaces of the bar are moved relative to the processing surface of said lapping surface plate by rotating said lapping surface plate and swinging the bar in a direction perpendicular to the rotating direction of said lapping surface plate.

8. The crown forming method of forming a crown on a floating type magnetic head according to claim 7, lapping is executed by boding a dummy bar, which has the same shape as that of the bar and is composed of the same material as that of the bar, to the convex surface of said jig spaced apart from the bar in parallel with the longitudinal direction thereof.

9. The crown forming method of forming a crown on a floating type magnetic head according to claim 6, lapping is executed by bonding a dummy bar, which has the same shape as that of the bar and is composed of the same material as that of the bar, to the convex surface of said jig spaced apart from the bar in parallel with the longitudinal direction thereof.

10. The crown forming method of forming a crown on a floating type magnetic head according to claim 5, wherein the respective divided surfaces of the bar are moved relative to the processing surface of said lapping surface plate by rotating said lapping surface plate and swinging the bar in a direction perpendicular to the rotating direction of said lapping surface plate.

11. The crown forming method of forming a crown on a floating type magnetic head according to claim 10, lapping is executed by bonding a dummy bar, which has the same shape as that of the bar and is composed of the same material as that of the bar, to the convex surface of said jig spaced apart from the bar in parallel with the longitudinal direction thereof.

12. The crown forming method of forming a crown on a floating type magnetic head according to claim 5, lapping is executed by bonding a dummy bar, which has the same shape as that of the bar and is composed of the same material as that of the bar, to the convex surface of said jig spaced apart from the bar in parallel with the longitudinal direction thereof.

* * * * *